US011673725B1

(12) United States Patent
Voorhees

(10) Patent No.: US 11,673,725 B1
(45) Date of Patent: Jun. 13, 2023

(54) CARTON DIVIDER

(71) Applicant: RATIONAL PACKAGING LLC, Springfield, TN (US)

(72) Inventor: Samuel C. Voorhees, Louisville, KY (US)

(73) Assignee: RATIONAL PACKAGING LLC, Springfield, TN (US)

( * ) Notice: Subject to any disclaimer, the term of this patent is extended or adjusted under 35 U.S.C. 154(b) by 264 days.

(21) Appl. No.: 17/200,783

(22) Filed: Mar. 13, 2021

(51) Int. Cl.
*B65D 71/38* (2006.01)

(52) U.S. Cl.
CPC ..... *B65D 71/38* (2013.01); *B65D 2571/0066* (2013.01); *B65D 2571/00141* (2013.01); *B65D 2571/00333* (2013.01)

(58) Field of Classification Search
CPC ..... B65D 2571/00561; B65D 2571/00512; B65D 2571/00358; B65D 2571/00333; B65D 71/138
USPC ..... 206/139
See application file for complete search history.

(56) References Cited

U.S. PATENT DOCUMENTS

| | | | | |
|---|---|---|---|---|
| 8,020,259 | B2 * | 9/2011 | Ho | F16L 3/222 24/339 |
| 8,985,347 | B2 * | 3/2015 | Thompson | A47J 47/16 211/74 |
| D778,176 | S * | 2/2017 | Long | D9/757 |
| 10,507,950 | B2 * | 12/2019 | Carrier | B65D 5/5045 |
| 2011/0114802 | A1 * | 5/2011 | Hjerpe | H02G 3/30 248/68.1 |

* cited by examiner

*Primary Examiner* — Anthony D Stashick
*Assistant Examiner* — Raven Collins
(74) *Attorney, Agent, or Firm* — Shaddock Law Group, PC

(57) ABSTRACT

A carton divider, including at least some of an elongate body; one or more adjacent semicylindrical portions, each including a sidewall that extends between opposing terminating sidewall ends to a vertex; an intermediate recurve portion that joins the terminating sidewall ends of adjacent semicylindrical portions; a first outer recurve portion extending along the terminating sidewall end of an outermost one of the semicylindrical portions; a second outer recurve portion extending along the terminating sidewall end of one other outermost one of the semicylindrical portions; at least one semicylinder slot, wherein portions of the first outer recurve portion, the second outer recurve portion, and the intermediate recurve portions proximate the semicylinder slot form recurve hinge portions; and at least one sidewall slot, wherein portions of each of the sidewalls proximate each the vertex forms a sidewall hinge portion. The carton divider can be folded to provide substantially cylindrical cavities.

20 Claims, 19 Drawing Sheets

CARTON DIVIDER

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of packaging elements. More specifically, the present disclosure relates to a carton divider.

2. Description of Related Art

It is generally known to use various packaging elements to help stabilize products within cartons or containers for storage or shipping. Typically, packaging elements are constructed so as to stabilize the contained item or items and provide a certain degree of cushioning against breakage, while being moved or transported.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, typical packaging elements have various shortcomings, particularly with regard to the packaging of plastic or glass bottles or other substantially cylindrically shaped objects. Among other things, known packaging elements do not provide adequate filling of void spaces between packaged products and the product carton or container. Known packaging elements or assemblies do not provide a sufficient cushioning to the packaged article or product. Additionally, known packaging elements do not provide sufficient stacking strength or resistance to longitudinal or transverse crushing.

Furthermore, known packaging assemblies and/or assembly components are cumbersome and have shapes that are not conducive to being packaged for shipment prior to assembly. Thus, shipping the packaging elements can be inefficient.

To overcome these and other shortcomings, the present disclosure provides a packaging element in the form of a carton divider, which allows for a degree of inward and/or outward flexion and resilient recovery toward the original shape. The carton divider of the present disclosure also includes a repeating or semi-repeating, semicylindrical pattern and optionally stabilizing projections that provide increased to compressional strength and allow the carton divider to better resist crushing (or resist a determined amount of crushing). For example, traditional packaging elements can leave the neck a portion of an inserted bottle more susceptible to crushing, while the packaging elements of the present disclosure reduce the susceptibility of crushing.

In various exemplary embodiments, the carton divider may initially be provided in an unfolded configuration so that the amount of space occupied by the carton divider can be reduced and a greater number of carton dividers can be packaged within a given shipment package.

Additionally, one or more optional semicylinder slots and/or sidewall slots may be included along portions of the carton divider to provide a line or portion along which the carton divider may be bent, folded, or formed. By bending or folding the carton divider along the semicylinder slots and/or sidewall slots, a portion of the carton divider can be urged from an initial, unfolded configuration to a packaging configuration. By initially providing the carton divider in an unfolded configuration, the amount of space occupied by the carton divider can be reduced and a greater number of carton dividers can be packaged within a given shipment package.

In various exemplary, nonlimiting embodiments, each carton divider portion of the present disclosure provides a multi-layer sheet or portion of material formed into a body having one or more substantially semicylinder portions, each of the adjacent semicylinder portions are joined together by a crest or recurve portion along the entire length of the body, along the longitudinal axis, $A_L$.

In various exemplary embodiments, when appropriately bent, folded, or formed, the carton divider of the present disclosure provides a series of substantially cylindrical openings, formed along the longitudinal axis, $A_L$, for placement of products.

In various exemplary, non-limiting embodiments, the carton divider of the present disclosure comprises at least some of an elongate portion of material, forming a body extending, along a longitudinal axis, from a first terminal end to a second terminal end and extending, along a transverse axis, from a terminating distal end to a terminating proximal end; one or more adjacent semicylindrical portions, extending along a longitudinal axis, from the first terminal end to the second terminal end, wherein each semicylindrical portion includes a sidewall that extends between opposing terminating sidewall ends to a vertex formed between the opposing terminating sidewall ends; an intermediate recurve portion extending along the entire length of the body, along the longitudinal axis, wherein the intermediate recurve portion joins the terminating sidewall ends of the adjacent semicylindrical portions; a first outer recurve portion extending along the terminating sidewall end of an outermost one of the semicylindrical portions, wherein the first outer recurve portion extends between the terminating sidewall end of the outermost one of the semicylindrical portions and the terminating proximal end; a second outer recurve portion extending along the terminating sidewall end of one other outermost one of the semicylindrical portions, wherein the second outer recurve portion extends between the terminating sidewall end of the other outermost one of the semicylindrical portions and the terminating distal end; a plurality of stabilizing projections, wherein at least two stabilizing projections extend outwardly from each of the semicylindrical portions between one of the terminating sidewall ends and the vertex of each semicylindrical portion; at least one semicylinder slot extending from the vertex toward the first outer recurve portion, the second outer recurve portion, and the intermediate recurve portions, wherein the at least one the semicylinder slot extends to but does not extend through the first outer recurve portion, the second outer recurve portion, and the intermediate recurve portions, and wherein portions of the first outer recurve portion, the second outer recurve portion, and the intermediate recurve portions proximate the semicylinder slot form recurve hinge portions; and at least one sidewall slot extending through and from a portion of the outer recurve portions and a portion of the intermediate recurve portions, toward the vertex, wherein the at least one sidewall slot extends through a portion of the sidewalls and through the stabilizing projections but does not extend through portions of the sidewalls proximate each the vertex and between the adjacent stabilizing projections of each of the adjacent semicylindrical portions, and wherein portions of each of the sidewalls proximate each the vertex and between the respective stabilizing projections forms a sidewall hinge portion.

In certain exemplary, nonlimiting embodiments, the body extends continuously, along the longitudinal axis, from the first terminal end to the second terminal end.

In certain exemplary, nonlimiting embodiments, the material used to form the body comprises a single layer of material.

In certain exemplary, nonlimiting embodiments, the material used to form the body comprises multiple layers of similar or dissimilar materials joined or adhesively bonded together to form the body.

In certain exemplary, nonlimiting embodiments, the body is formed of paperboard, chipboard, container board, box board, cardboard, or corrugated fiberboard.

In certain exemplary, nonlimiting embodiments, a semicylindrical trough is defined within an interior of the sidewalls.

In certain exemplary, nonlimiting embodiments, the carton divider includes three semicylindrical portions.

In certain exemplary, nonlimiting embodiments, each of the stabilizing projections extends outward from each of the semicylindrical portions spaced apart from the vertex of each semicylindrical portion.

In certain exemplary, nonlimiting embodiments, each of the stabilizing projections extends so as to be substantially coplanar, along the transverse axis, with the vertices of the semicylindrical portions.

In certain exemplary, nonlimiting embodiments, each of the stabilizing projections is formed of a substantially circular or ovular projection extending from the semicylindrical portions.

In certain exemplary, nonlimiting embodiments, the body is presented in an unfolded configuration.

In certain exemplary, nonlimiting embodiments, a plurality of carton dividers are presented in an unfolded configuration and are positioned adjacent one another such that at least a portion of the semicylindrical portions of a first carton divider is nested within at least a portion of the semicylindrical portions of a second, adjacent carton divider.

In certain exemplary, nonlimiting embodiments, the at least one the semicylinder slot and the sidewall slots are formed at spaced apart locations in a repeating pattern between the first terminal end and the second terminal end.

In certain exemplary, nonlimiting embodiments, the vertex of each respective semicylindrical portion is formed equidistance from the opposing terminating sidewall ends of the respective semicylindrical portion.

In certain exemplary, nonlimiting embodiments, the at least one the semicylinder slot and the sidewall slots extend across the semicylindrical portions, parallel to the transverse axis of the carton divider and is formed of an elongate slip, groove, cut, or separation through the body.

In certain exemplary, nonlimiting embodiments, the at least one the semicylinder slot and the sidewall slots are formed of perforations through the body.

In certain exemplary, nonlimiting embodiments, the at least one the semicylinder slot and the sidewall slots provide flexible or semi-flexible areas or portions of material such that portions of the body may be folded along the at least one the semicylinder slot and the sidewall slots.

In certain exemplary, nonlimiting embodiments, one semicylinder slot is formed proximate a center of the body and wherein two sidewall slots are formed at spaced apart locations along the body.

In certain exemplary, nonlimiting embodiments, the at least one semicylinder slot and the sidewall slots are formed substantially equidistant from one another.

In various exemplary, non-limiting embodiments, the carton divider of the present disclosure comprises at least some of an elongate body extending, along a longitudinal axis, from a first terminal end to a second terminal end and extending, along a transverse axis, from a terminating distal end to a terminating proximal end; one or more adjacent semicylindrical portions, extending substantially parallel to the longitudinal axis, from the first terminal end to the second terminal end, wherein each semicylindrical portion includes a sidewall that extends between opposing terminating sidewall ends, wherein a vertex is formed between the opposing terminating sidewall ends; an intermediate recurve portion extending substantially parallel to the longitudinal axis, wherein the intermediate recurve portion joins the terminating sidewall ends of the adjacent semicylindrical portions; a first outer recurve portion extending along the terminating sidewall end of an outermost one of the semicylindrical portions, wherein the first outer recurve portion extends between the terminating sidewall end of the outermost one of the semicylindrical portions and the terminating proximal end; a second outer recurve portion extending along the terminating sidewall end of one other outermost one of the semicylindrical portions, wherein the second outer recurve portion extends between the terminating sidewall end of the other outermost one of the semicylindrical portions and the terminating distal end; a plurality of stabilizing projections, wherein at least two stabilizing projections extend outwardly from each of the semicylindrical portions between the terminating sidewall ends and the vertex of each semicylindrical portion; at least one semicylinder slot extending from the vertex toward the first outer recurve portion, the second outer recurve portion, and the intermediate recurve portions, wherein the at least one the semicylinder slot extends to the first outer recurve portion, the second outer recurve portion, and the intermediate recurve portions, and wherein portions of the first outer recurve portion, the second outer recurve portion, and the intermediate recurve portions proximate the semicylinder slot form recurve hinge portions; and at least one sidewall slot extending through a portion of the outer recurve portions and a portion of the intermediate recurve portions, toward the vertex, wherein the at least one sidewall slot extends through a portion of the sidewalls and through the stabilizing projections but does not extend through portions of the sidewalls proximate each the vertex and between the adjacent stabilizing projections of each of the adjacent semicylindrical portions, and wherein portions of each of the sidewalls proximate each the vertex and between the respective stabilizing projections forms a sidewall hinge portion.

In various exemplary, non-limiting embodiments, the carton divider of the present disclosure comprises at least some of an elongate body extending, along a longitudinal axis, from a first terminal end to a second terminal end and extending, along a transverse axis, from a terminating distal end to a terminating proximal end; one or more adjacent semicylindrical portions, extending substantially parallel to the longitudinal axis, from the first terminal end to the second terminal end, wherein each semicylindrical portion includes a sidewall that extends between opposing terminating sidewall ends, wherein a vertex is formed between the opposing terminating sidewall ends; an intermediate recurve portion, wherein the intermediate recurve portion joins the terminating sidewall ends of the adjacent semicylindrical portions; a first outer recurve portion extending along the terminating sidewall end of an outermost one of the semicylindrical portions, wherein the first outer recurve portion extends between the terminating sidewall end of the outermost one of the semicylindrical portions and the terminating proximal end; a second outer recurve portion extending along the terminating sidewall end of one other outermost one of the semicylindrical portions, wherein the second outer recurve portion extends between the terminating sidewall end of the other outermost one of the semicylindrical portions and the terminating distal end; at least one semicylinder slot extending from the vertex toward the first outer recurve portion, the second outer recurve portion, and the intermediate recurve portions, wherein the at least one the semicylinder slot extends to the first outer recurve portion, the second outer recurve portion, and the intermediate recurve portions, and wherein portions of the first outer recurve portion, the second outer recurve portion, and the intermediate recurve portions proximate the semicylinder slot form recurve hinge portions; and at least one sidewall slot extending through a portion of the outer recurve portions and a portion of the intermediate recurve portions, toward the vertex, wherein the at least one sidewall slot extends through a portion of the sidewalls but does not extend through portions of the sidewalls proximate each the vertex, and wherein portions of each of the sidewalls proximate each the vertex forms a sidewall hinge portion.

Accordingly, the present disclosure provides a carton divider that can be easily and accurately positioned within at least a portion of an interior cavity of a product carton or container.

The present disclosure separately provides a carton divider that provides lower costs for handling and storage.

The present disclosure separately provides a carton divider with compressional strength.

The present disclosure separately provides a carton divider with stacking strength.

The present disclosure separately provides a carton divider that provides an element for filling of void spaces between packaged products and the product carton or container.

The present disclosure separately provides a carton divider that provides an increased level of cushioning to a packaged article or product within a product carton or container.

The present disclosure separately provides a carton divider that provides a level of stacking strength and/or resistance to longitudinal and/or transverse crushing.

The present disclosure separately provides a carton divider that provides a shape that is conducive to being packaged for shipment prior to assembly.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein.

Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein. However, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE INVENTION

Figure 1:
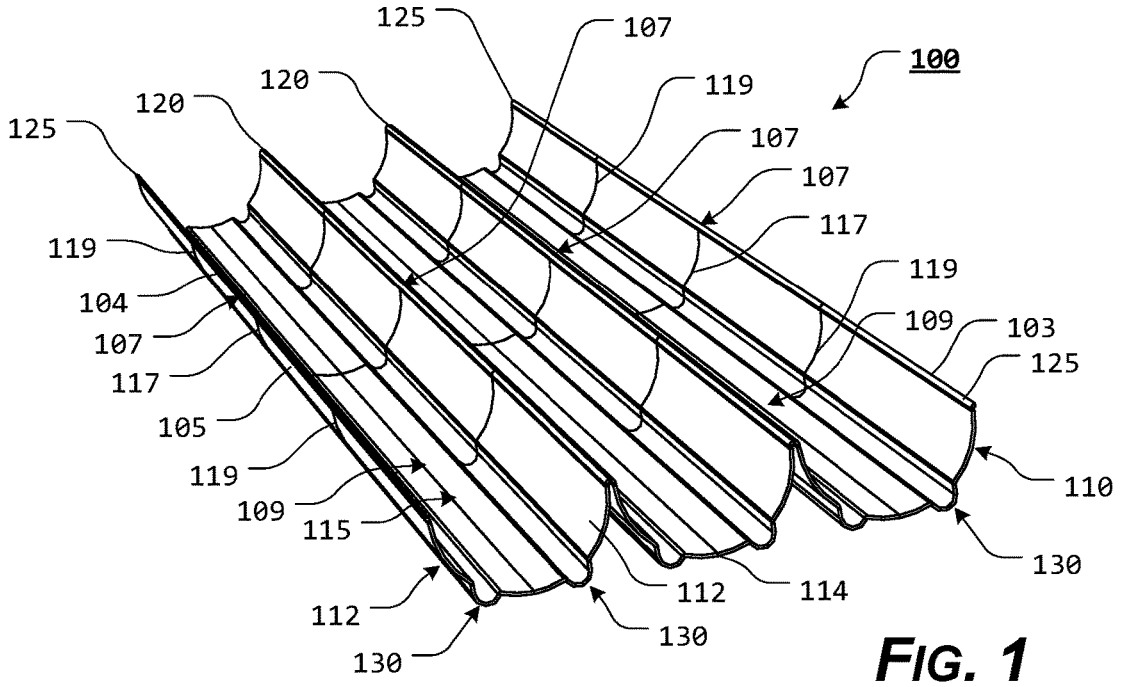
FIG. 1 illustrates an upper, front, left perspective view of an exemplary embodiment of a carton divider in an unfolded configuration, according to the present disclosure.
Figure 2:
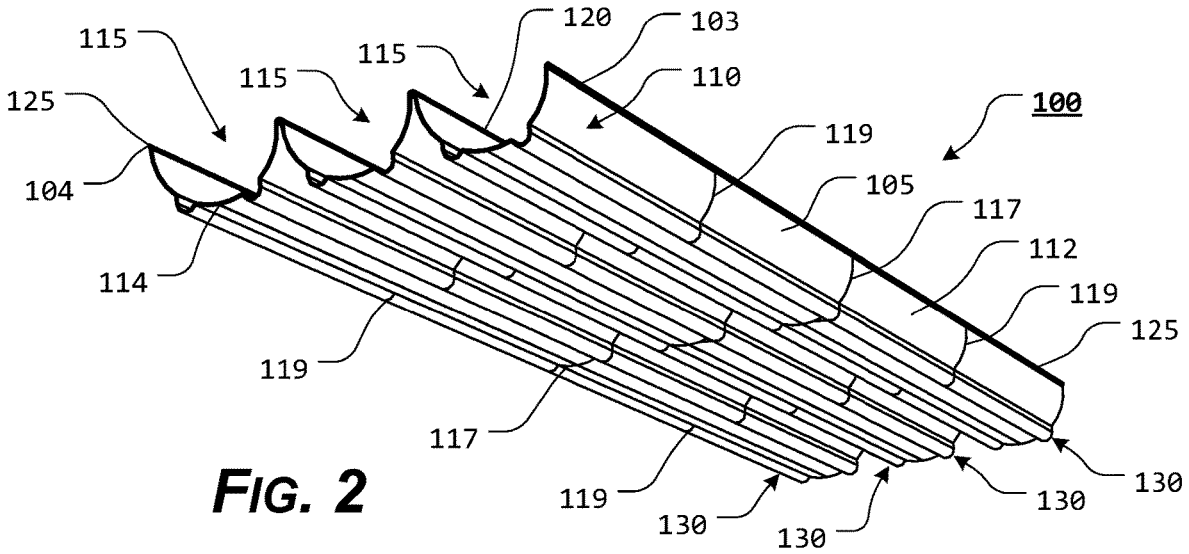
FIG. 2 illustrates a lower, front, right perspective view of an exemplary embodiment of a carton divider in an unfolded configuration, according to the present disclosure.

For simplicity and clarification, the design factors and operating principles of the carton divider are explained with reference to various exemplary embodiments of a carton divider according to the present disclosure. The basic explanation of the design factors and operating principles of the carton divider is applicable for the understanding, design, and operation of the carton divider of the present disclosure. It should be appreciated that the carton divider can be adapted to applications where a packaging element can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "packaging element" and "carton divider" are used for basic explanation and understanding of the operation of the systems, methods, and apparatuses of the present disclosure. Therefore, the terms "packaging element" and "carton divider" are not to be construed as limiting the systems, methods, and apparatuses of the present disclosure. Additionally, the term "semi-cylindrical" is not to be construed as limiting the present disclosure. For example, and various exemplary embodiments, portions of the carton divider of the present disclosure take on a substantially semicylindrical, partially ovular, partially elliptical, partially triangular, partially rectangular, or shaped, when viewed from the front or rear. Thus, it should be appreciated that the profile of the carton divider is a design choice, based upon the desired product or products with which the carton divider is to be utilized.

Figure 23:
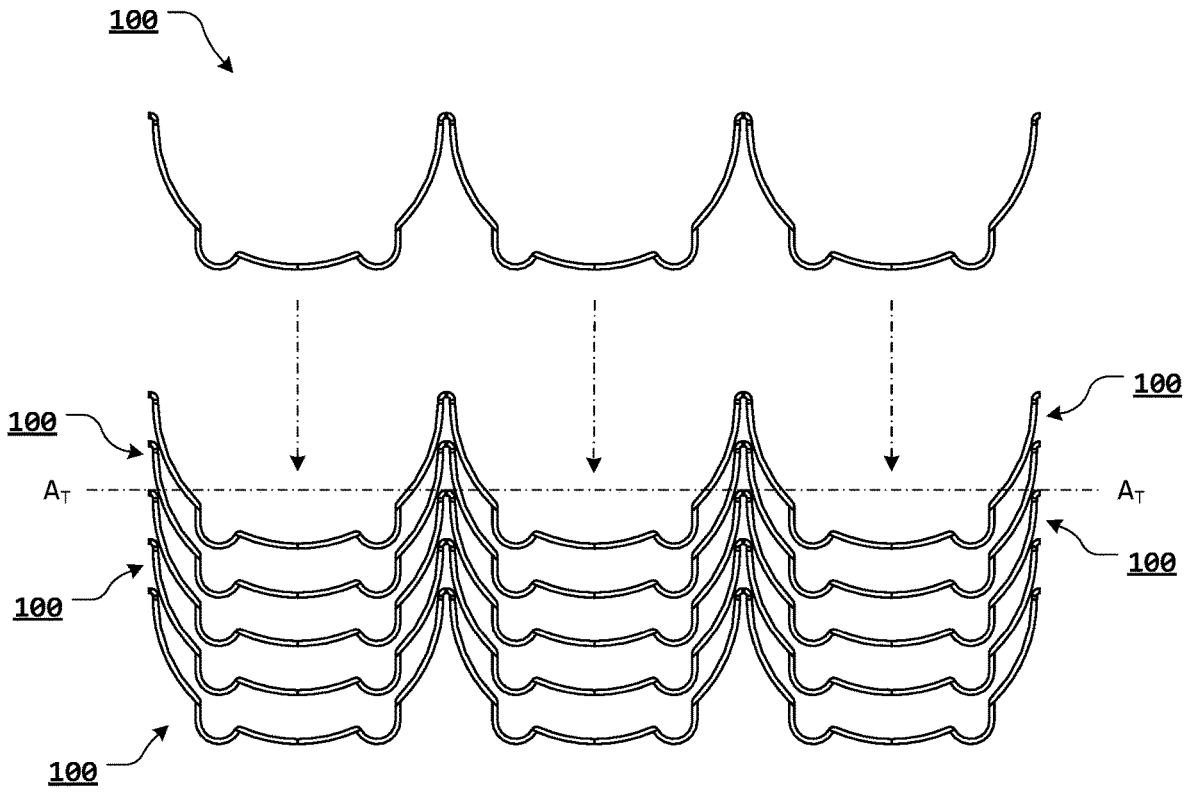
FIG. 23 illustrates a front view of several exemplary carton dividers in an unfolded configuration being nested together, according to the present disclosure.
Figure 24:
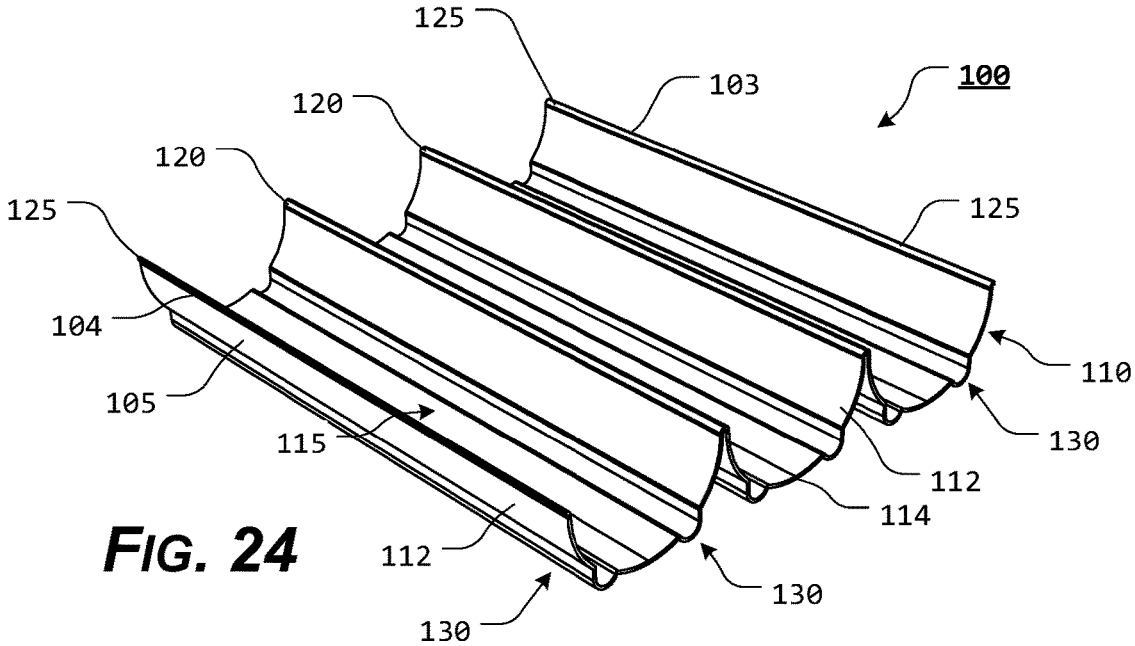
FIG. 24 illustrates an upper, front, left perspective view of an exemplary embodiment of a carton divider in an unfolded configuration, according to the present disclosure.
Figure 25:
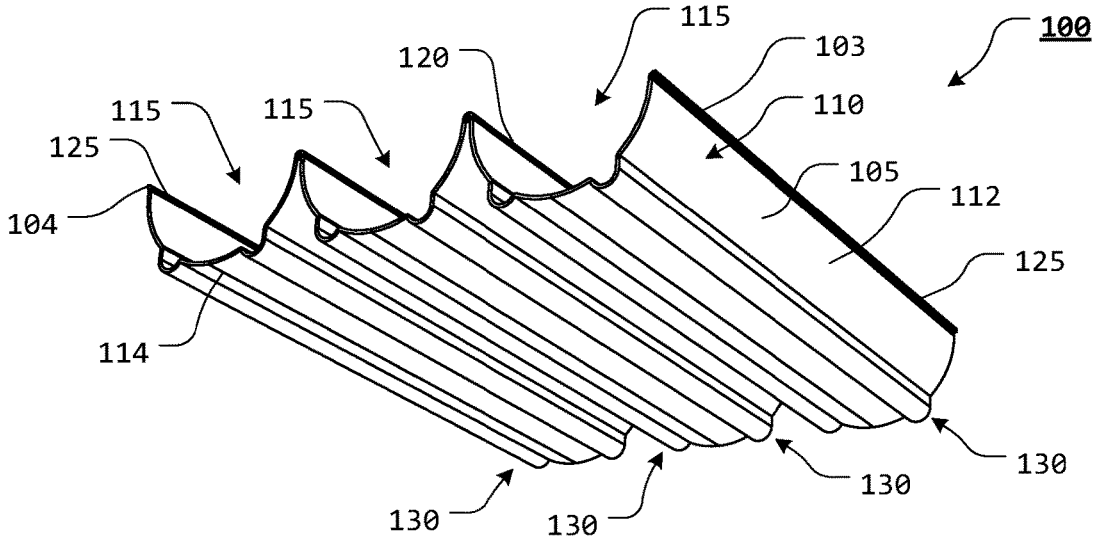
FIG. 25 illustrates a lower, front, right perspective view of an exemplary embodiment of a carton divider in an unfolded configuration, according to the present disclosure.
Figure 26:
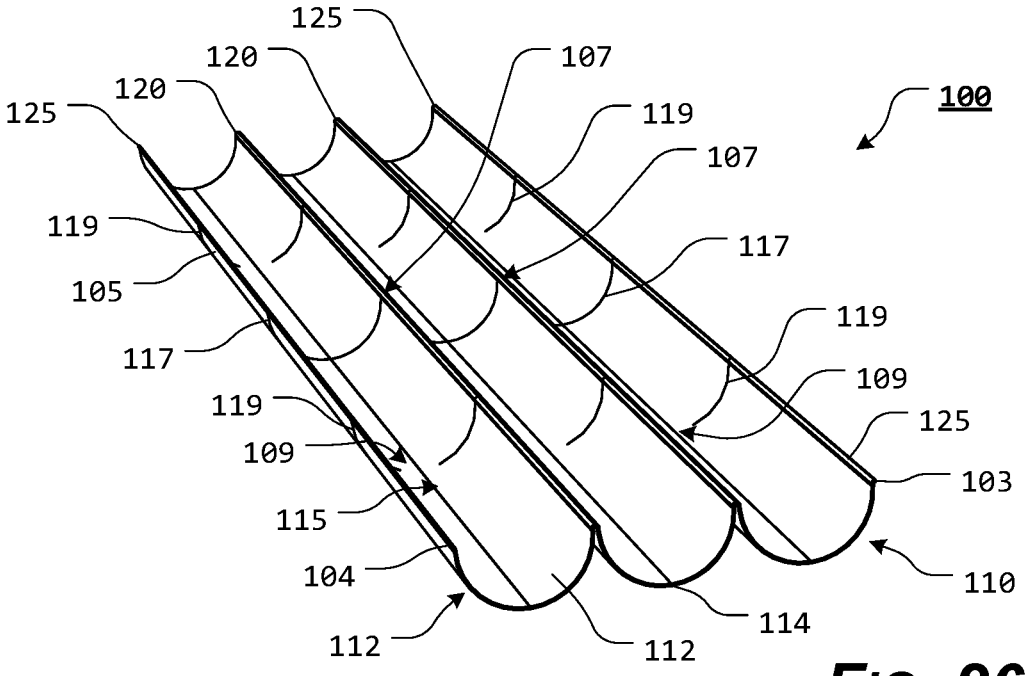
FIG. 26 illustrates an upper, front, left perspective view of an exemplary embodiment of a carton divider in an unfolded configuration, according to the present disclosure.
Figure 27:
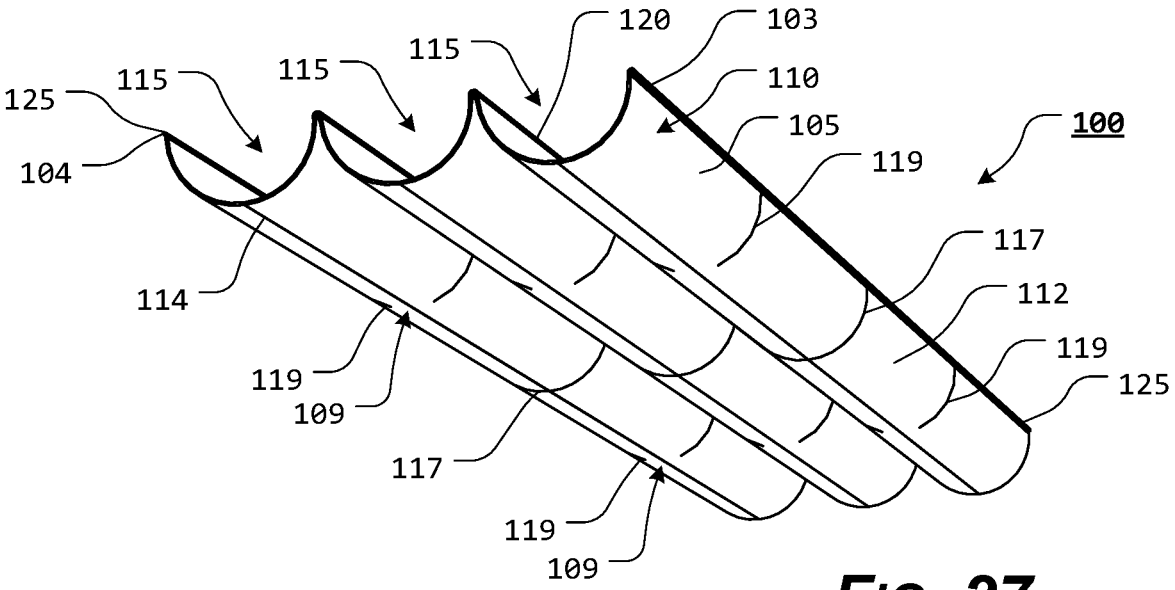
FIG. 27 illustrates a lower, front, right perspective view of an exemplary embodiment of a carton divider in an unfolded configuration, according to the present disclosure.
Figure 28:
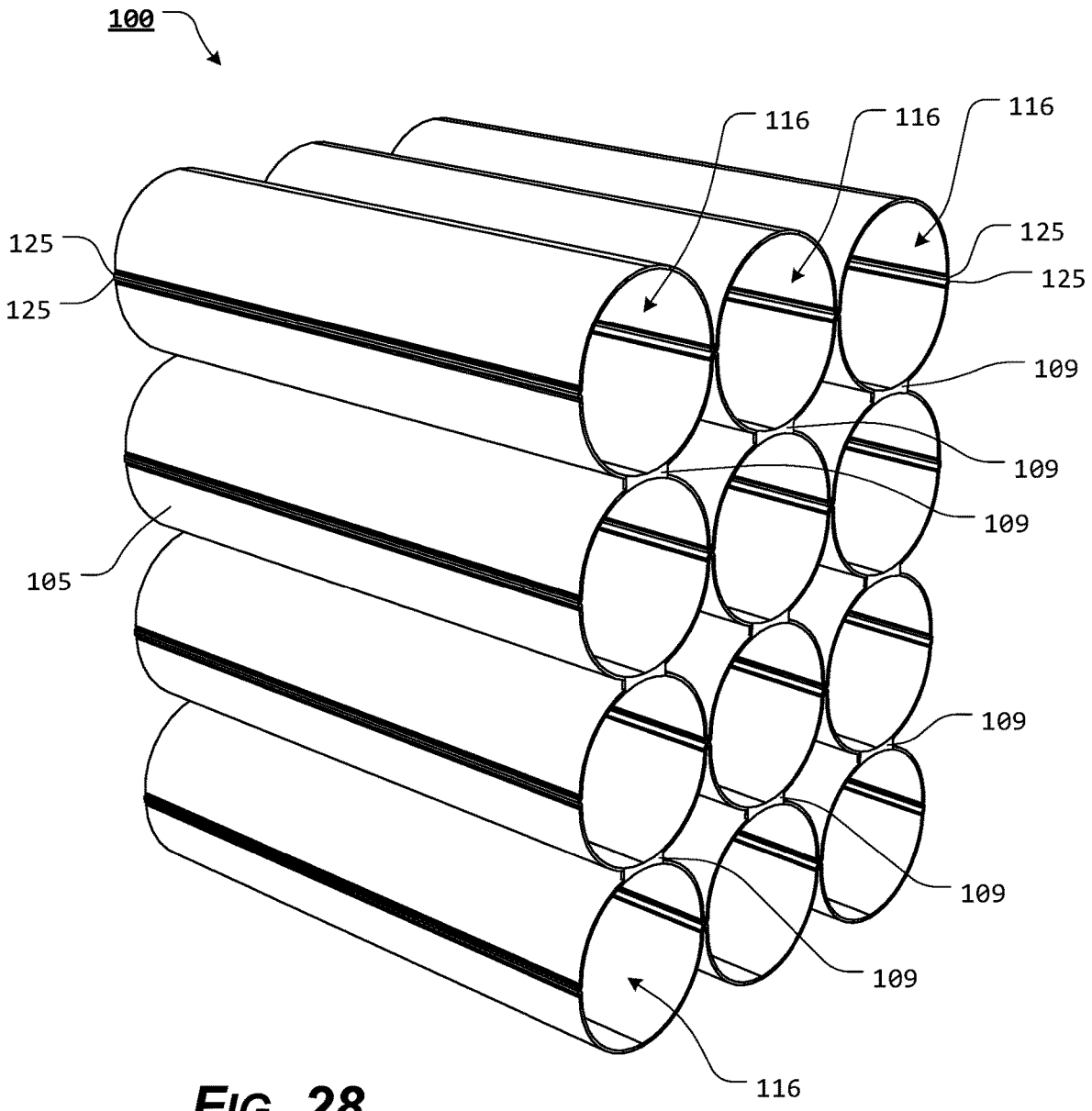
FIG. 28 illustrates an upper, rear, right perspective view of an exemplary embodiment of a carton divider in a packaging configuration, according to the present disclosure.
Figure 29:
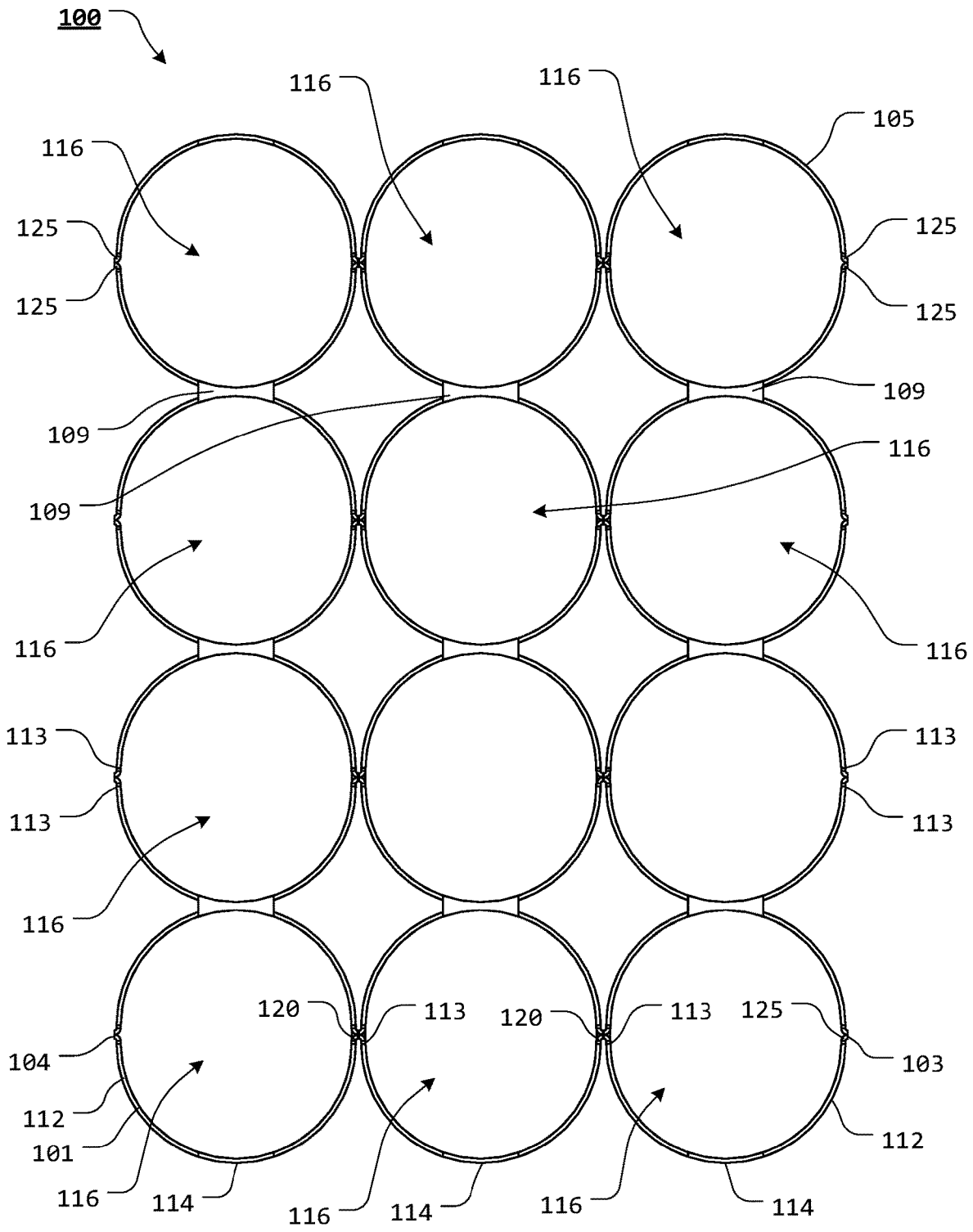
FIG. 29 illustrates a lower, rear, right perspective view of an exemplary embodiment of a carton divider in a packaging configuration, according to the present disclosure.
Figure 30:
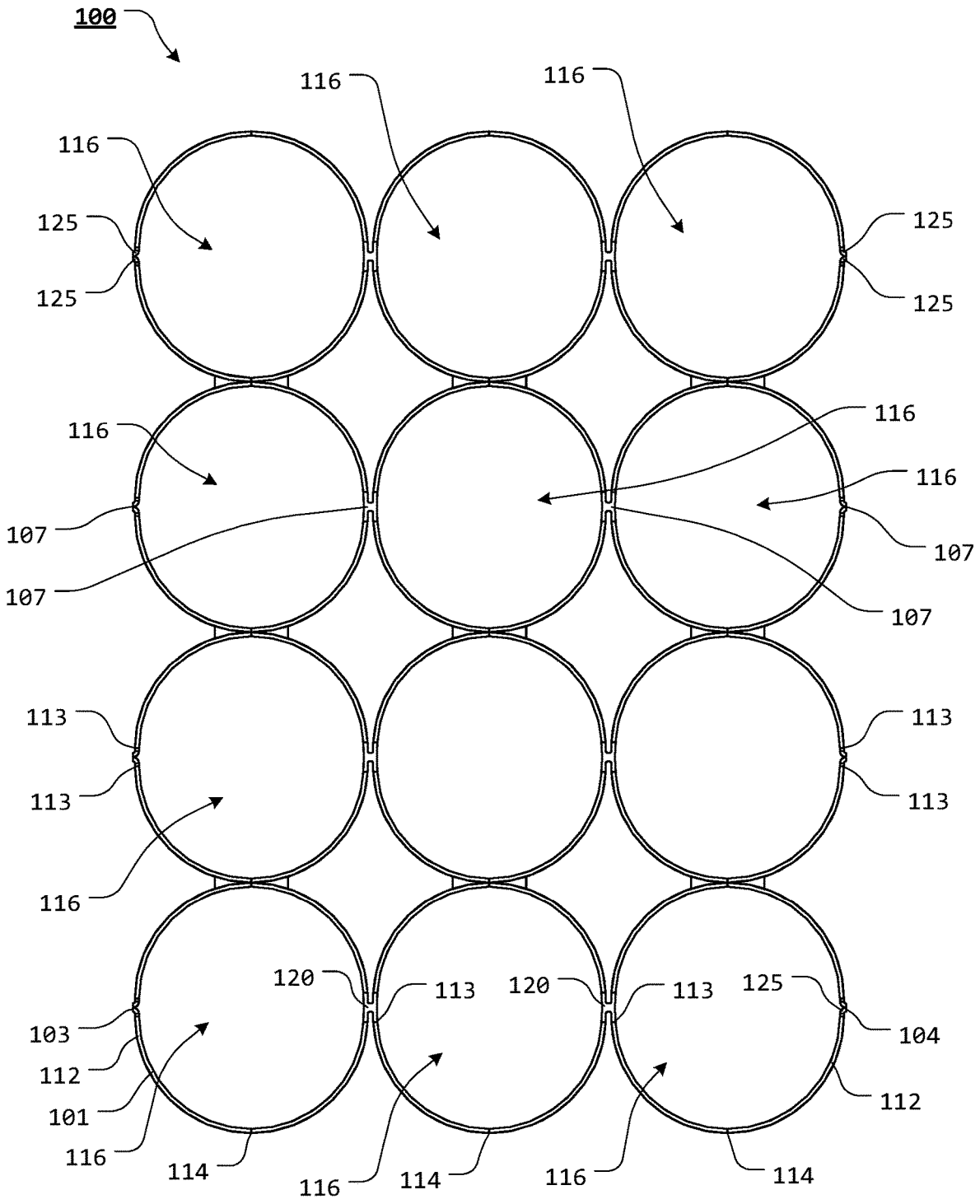
FIG. 30 illustrates a rear view of an exemplary embodiment of a carton divider in a packaging configuration, according to the present disclosure.

Turning now to the appended drawing figures, FIGS. 1-23 illustrate certain elements and/or aspects of an exemplary embodiment of a carton divider 100, according to the present disclosure. FIGS. 24-25 illustrate certain elements and/or aspects of an alternative exemplary embodiment of a carton divider 100, while FIGS. 26-30 illustrate certain elements and/or aspects of yet another exemplary embodiment of a carton divider 100, according to the present disclosure.

In illustrative, non-limiting embodiment(s) of the present disclosure, as illustrated most clearly in FIGS. 1-23, the carton divider 100 comprises an elongate portion of material, forming a body 105, which extends, along a longitudinal axis, $A_L$, from a first terminal end 101 to a second terminal end 102. In various exemplary embodiments, the body 105 extends continuously (or continuously, but for the semicylinder slots 117 and sidewall slots 119), in an uninterrupted manner, from the first terminal end 101 to the second terminal end 102.

The portion of material or body 105 also extends continuously, extending substantially parallel to a transverse axis, $A_T$ (substantially perpendicular to the longitudinal axis, $A_L$), from a terminating distal end 104 to a terminating proximal end 103.

In various exemplary embodiments, the material used to form the body 105 comprises a single layer of material. Alternatively, the material used to form body 105 comprises multiple layers of similar or dissimilar materials joined or adhesively bonded together to form the body 105. Thus, it should be appreciated that the body 105 may comprise a single layer of material or may be a multi-layer body 105 formed of a laminate of a plurality of layers of material attached or coupled by an adhesive or other means.

The body 105 may also be formed of a thick sheet, such as, for example, paperboard, chipboard, container board, box board, cardboard, or corrugated fiberboard.

In various exemplary embodiments, the body 105 is substantially rigid and is formed of cardboard. Alternate materials of construction of the body 105 may include one or more of the following: thick paper (of various types), pasteboard, paperboard, container board, corrugated fiberboard, box board, or chipboard. In still other exemplary embodiments, alternate materials of construction of the body 105 may include one or more the following: wood, steel, stainless steel aluminum, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material used to form the body 105 is a design choice based on the desired appearance and functionality of the body 105.

Figure 3:
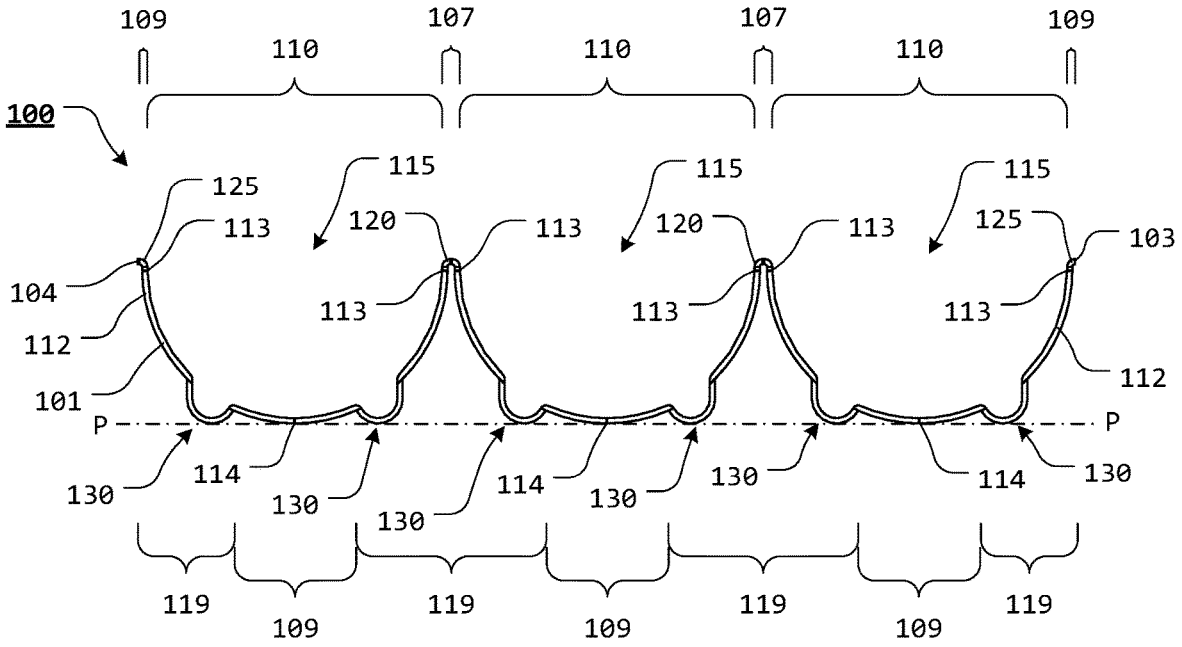
FIG. 3 illustrates a front view of an exemplary embodiment of a carton divider in an unfolded configuration, according to the present disclosure.
Figure 4:
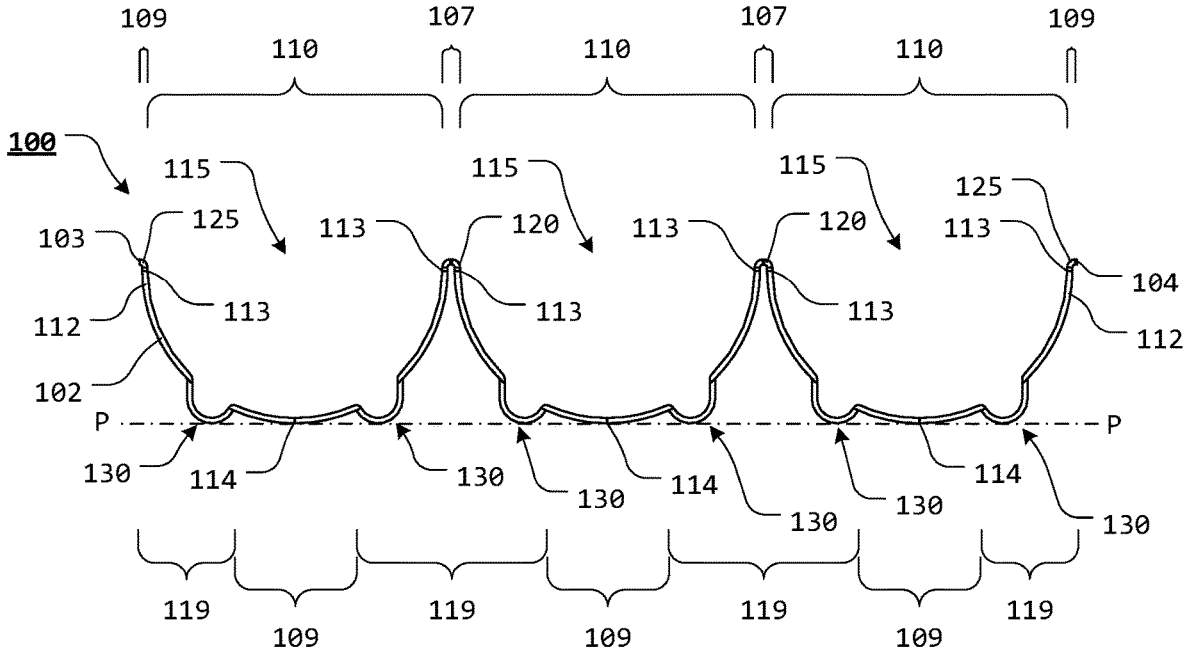
FIG. 4 illustrates a rear view of an exemplary embodiment of a carton divider in an unfolded configuration, according to the present disclosure.
Figure 5:
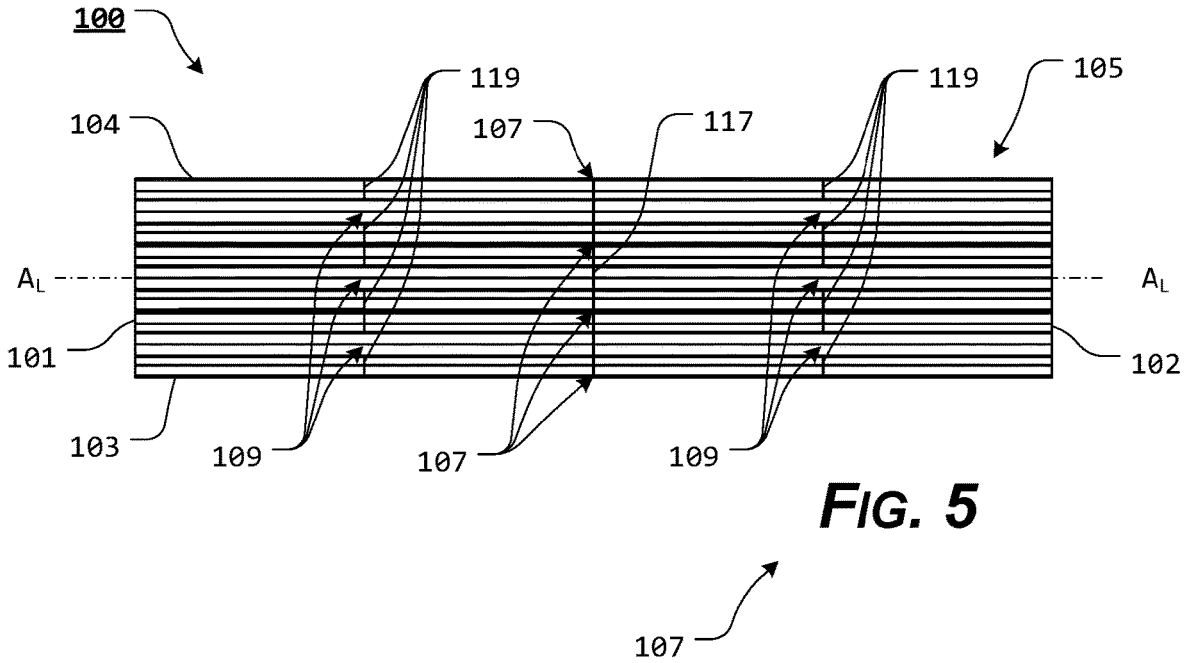
FIG. 5 illustrates a top view of an exemplary embodiment of a carton divider in an unfolded configuration, according to the present disclosure.
Figure 6:
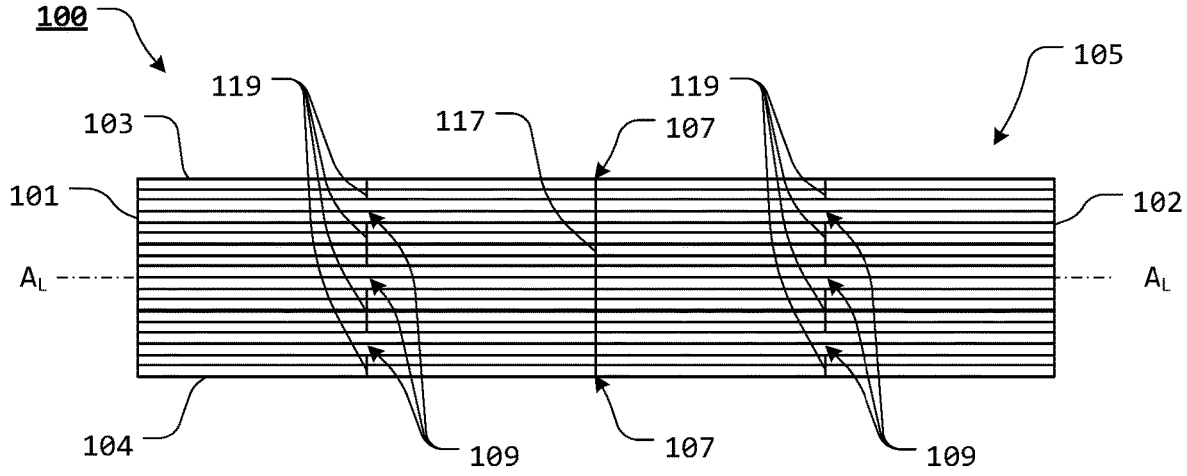
FIG. 6 illustrates a bottom view of an exemplary embodiment of a carton divider in an unfolded configuration, according to the present disclosure.
Figure 7:
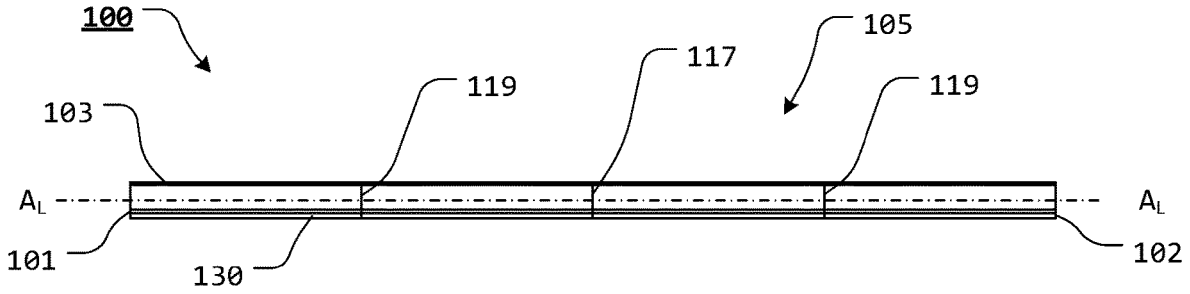
FIG. 7 illustrates a right side view of an exemplary embodiment of a carton divider in an unfolded configuration, according to the present disclosure.
Figure 8:
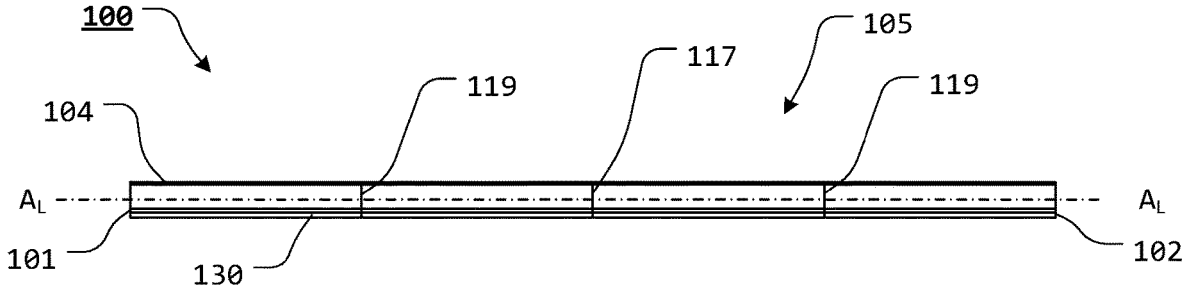
FIG. 8 illustrates a left side view of an exemplary embodiment of a carton divider in an unfolded configuration, according to the present disclosure.

As most easily seen when viewed from the front or rear, as illustrated, for example, in FIGS. 3 and 4, the body 105 includes one or more semicylindrical portions 110, extending parallel to one another, along the length of the body 105, from the first terminal end 101 to the second terminal end 102. Each semicylindrical portion 110 includes a sidewall 112 that extends between opposing terminating sidewall ends 113 to a vertex 114. A semicylindrical trough 115 is defined by and formed within the interior of the sidewalls 112. The semicylindrical trough 115 extends along the entire length of the body 105, along the longitudinal axis, $A_L$, from the first terminal end 101 to the second terminal end 102.

In various exemplary embodiments, as illustrated herein, the carton divider 100 includes three semicylindrical portions 110. It should be appreciated that the number of semicylindrical portions 110 used to form the carton divider 100 is a design choice, based upon the desired number of resulting substantially cylindrical cavities 116, the desired number of items to be positioned within an interior cavity 155 of a product carton or container 150, and/or the size of the interior cavity 155 of the product carton or container 150 with which the carton divider 100 is to be used.

Each of the adjacent semicylindrical portions 110 are joined together by a crest or intermediate recurve portion 120 extending along the entire length of the body 105, along the longitudinal axis, $A_L$. In this manner, the terminating sidewall ends 113 of the adjacent semicylindrical portions 110 are joined together by a crest or intermediate recurve portion 120.

An outer recurve portion 125 extends along each outermost terminating sidewall end 113. A first outer recurve portion 125 extends from a terminating sidewall end 113 of an outermost semicylindrical portion 110 to the terminating proximal end 103, while a second outer recurve portion 125 extends from a terminating sidewall end 113 of another outermost semicylindrical portion 110 to the terminating distal end 104. Each of the first and the second outer recurve portions 125 forms an outwardly extending curved portion of the carton divider 100.

Thus, the carton divider 100 forms a corrugated body 105 having parallel and alternating ridges (intermediate recurve portions 120 and outer recurve portions 125) and grooves (semicylindrical portions 110).

In various exemplary embodiments, stabilizing projections 130 extend outwardly from one or more portions of each semicylindrical portion 110. In various exemplary embodiments, the stabilizing projections 130 extend so as to be substantially coplanar, relative to the plane P, along the transverse axis, $A_T$, with the aligned vertices 114 of the semicylindrical portions 110. In this manner, at least one line along a portion of each stabilizing projection 130 is tangent to at least one line along a portion of each of the aligned vertices 114 of the semicylindrical portions 110.

Generally, a stabilizing projection 130 extends from a portion of the semicylindrical portion 110 between each terminating sidewall end 113 and the vertex 114 of each semicylindrical portion 110.

In various exemplary embodiments, each stabilizing projection 130 may be formed of a substantially circular or ovular projection extending from the semicylindrical portions 110. Alternatively, each stabilizing projection 130 may be formed of an alternative shape extending from the semicylindrical portions 110.

Each of the stabilizing projections 130, if included, provides additional contact between an interior surface of the interior cavity 155 of a product carton or container 150 or an adjacent exterior portion of a stabilizing projection 130 (when the carton divider 100 is in the packaging configuration). By providing additional contact surfaces or points, the stability of the carton divider 100 and the stability of the carton divider 100 within the interior cavity 155 of the product carton or container 150 is increased.

As illustrated, for example, in FIGS. 1-8, the body 105 may initially be presented in the unfolded configuration. In this position, the semicylindrical portions 110, the intermediate recurve portions 120, and the outer recurve portions 125 retain the described shapes and are not flattened, but the overall body 105 is provided in an unfolded or "flattened" configuration, with respect to the longitudinal axis, $A_L$, of the body 105. Because the body 105 may initially be presented in the unfolded configuration, a plurality of "unfolded" or "flattened" carton dividers 100 can be positioned adjacent one another such that at least a portion of the semicylindrical portions 110 of a first carton divider 100 may be "nested" within at least a portion of the semicylindrical portions 110 of a second, adjacent carton divider 100, as illustrated in FIG. 23. Thus, the area required for the carton dividers 100 allows carton dividers 100 to be more densely packaged in a particular packaging container. When ready for usage, a carton divider 100 can be from the nested group of carton dividers 100 and folder bent from the unfolded configuration to the packaging configuration.

The body 105 is formed so as to be bent or folded from the unfolded configuration to a packaging configuration. To allow portions of the body 105 to be comparatively more easily bent or folded, semicylinder slots 117 and sidewall slots 119 are formed at spaced apart locations in a repeating pattern between the first terminal end 101 and the second terminal end 102. Providing semicylinder slots 117 and sidewall slots 119 allows the material of the carton divider 100 or the body 105 to be more easily bent or folded or to form a more even or more consistent bend or fold.

In certain exemplary embodiments, the semicylinder slot (s) 117 extend, from the vertex 114, toward the outer recurve portions 125 and the intermediate recurve portions 120. Each semicylinder slot 117 extends to but does not extend through each outer recurve portion 125 and intermediate recurve portion 120. In this manner, the remaining outer recurve portion 125 and remaining intermediate recurve portion 120 form recurve hinge portions 107.

Each semicylinder slot 117 extends across the semicylindrical portions 110, parallel to the transverse axis, $A_T$, of the carton divider 100 and is formed of an elongate slip, groove, cut, or separation through the material or body 105. In various exemplary embodiments, the semicylinder slot 117 may be formed of perforations through the body 105, without creating a complete cut, but allowing the remaining material along the perforated semicylinder slot 117 to be comparatively more easily torn or separated, allowing a complete separation along the semicylinder slot 117, if desired.

Figure 11:
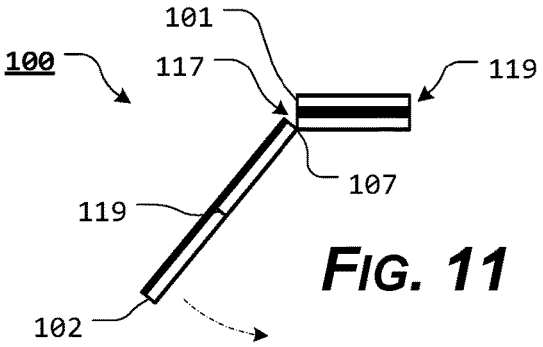
FIG. 11 illustrates a right side view of an exemplary embodiment of a carton divider in a partially folded configuration, being bent or folded from an unfolded configuration to a packaging configuration, according to the present disclosure.

The remaining recurve hinge portions 107 provide a flexible or semi-flexible area or portion of material that remains and acts as a hinge, when the body 105 is folded along the semicylinder slot 117, as illustrated most clearly in FIG. 11.

In various exemplary embodiments, as illustrated, for example, in FIGS. 1-14, a single, semicylinder slot 117 may be formed proximate a center of the body 105, relative to the longitudinal axis, $A_L$, of the body 105. However, it should be appreciated that the number of semicylinder slots 117 formed in the body 105 is a design choice, based upon the desired number of resulting substantially cylindrical cavities 116.

In certain exemplary embodiments, the sidewall slot(s) 119 extend, through and from the outer recurve portions 125 and a portion of the intermediate recurve portions 120, toward the vertex 114. Each sidewall slot 119 extends through a portion of the sidewalls 112 and through the stabilizing projections 130 but does not extend through portions of the sidewalls 112 proximate the vertex 114, between the adjacent stabilizing projections 130. In this manner, the remaining portion of each of the sidewalls 112, proximate each vertex 114 and between the respective stabilizing projections 130 forms a sidewall hinge portion 109.

Each sidewall slot 119 extends across the semicylindrical portions 110, parallel to the transverse axis, $A_T$, of the carton divider 100 and is formed of an elongate slip, groove, cut, or separation through the material or body 105. In various exemplary embodiments, the sidewall slot 119 may be formed of perforations through the body 105, without creating a complete cut, but allowing the remaining material along the perforated sidewall slots 119 to be comparatively more easily torn or separated, allowing a complete separation along the sidewall slots 119, if desired.

Figure 9:
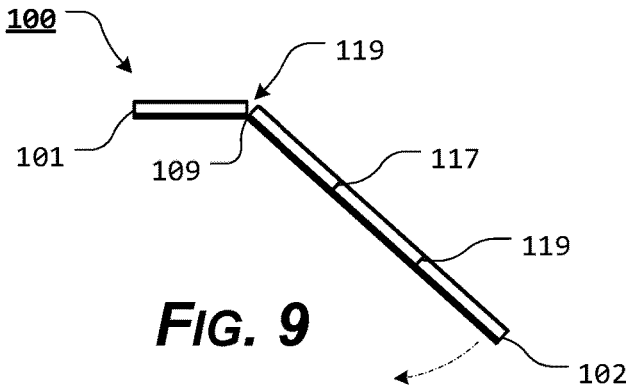
FIG. 9 illustrates a right side view of an exemplary embodiment of a carton divider in a partially folded configuration, being bent or folded from an unfolded configuration to a packaging configuration, according to the present disclosure.
Figure 13:
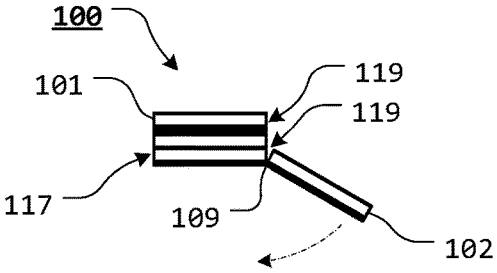
FIG. 13 illustrates a right side view of an exemplary embodiment of a carton divider in a partially folded configuration, being bent or folded from an unfolded configuration to a packaging configuration, according to the present disclosure.

The sidewall hinge portions 109 provide a flexible or semi-flexible area or portion of material that remains and acts as a hinge, when the body 105 is folded along the sidewall slots 119, as illustrated most clearly in FIGS. 9 and 13.

In various exemplary embodiments, as illustrated, for example, in FIGS. 1-14, two sidewall slots 119 may be formed at spaced apart locations along the body 105, on either side of the semicylinder slot 117. However, it should be appreciated that the number of sidewall slots 119 formed in the body 105 is a design choice, based upon the desired number of resulting substantially cylindrical cavities 116.

In order to provide semicylindrical portions 110 of equal length, when in a packaging configuration, a distance between the first terminal end 101 and a first sidewall slot 119 is equal to a distance between the first sidewall slot 119 and the semicylinder slot 117, which is equal to a distance between the semicylinder slot 117 and a second sidewall slot 119, which is equal to a distance between the second sidewall slot 119 and the second terminal end 102.

In various exemplary embodiments, the semicylinder slot(s) 117 and sidewall slots 119 may be formed substantially equidistant from one another and a first or second semicylinder slot 117 or sidewall slot 119 may be formed equal distance from the first terminal end 101 or the second terminal end 102. Alternatively, the semicylinder slot(s) 117 and sidewall slots 119 may be formed at different distances from one another and a first or second semicylinder slot 117 or sidewall slot 119 may be formed at a different distance from the first terminal end 101 or the second terminal end 102.

It is also be appreciated that while FIGS. 1-14 show two sidewall slots 119 formed at spaced apart locations along the body 105 and a single semicylinder slot 117 formed between and equidistant from each of the two sidewall slots 119, this is illustrative and not limiting. It should be appreciated that the number of sidewall slots 119 and the semicylinder slots 117 is a design choice and may be varied based upon the desired functionality of the resulting carton divider 100. A plurality of alternating sidewall slots 119 and semicylinder slots 117 may be provided along the longitudinal axis, $A_L$, of body 105.

Figure 10:
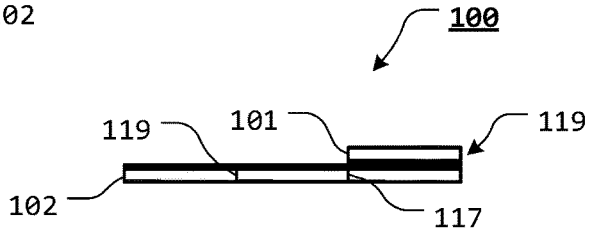
FIG. 10 illustrates a right side view of an exemplary embodiment of a carton divider in a partially folded configuration, being bent or folded from an unfolded configuration to a packaging configuration, according to the present disclosure.

During transition of the carton divider 100 from the unfolded configuration to the packaging configuration, as illustrated most clearly in FIGS. 9-14, portions of the body 105 are bent or folded. During this transition, the carton divider 100 is initially presented in an unfolded configuration, as illustrated, for example, in FIGS. 1-8. As illustrated in FIG. 9, a portion of the body 105 relative to the first terminal end 101 is maintained in a substantially stationary position and a portion of the body relative to the second terminal end 102 is urged so as to bend along a first sidewall slot 119, toward the first terminal end 101. Once appropriately bent or folded, as illustrated in FIG. 10, the first terminal end 101 is positioned proximate the semicylinder slot 117 (provided the distance between the first terminal end 101 and the first sidewall slot 119 is equal to a distance between the first sidewall slot 119 and the semicylinder slot 117).

Figure 12:
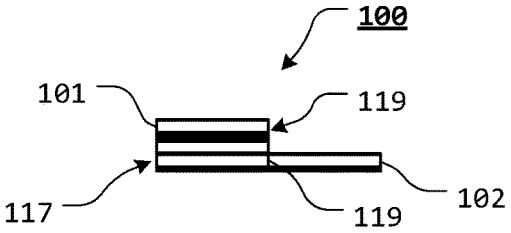
FIG. 12 illustrates a right side view of an exemplary embodiment of a carton divider in a partially folded configuration, being bent or folded from an unfolded configuration to a packaging configuration, according to the present disclosure.

Next, as illustrated in FIG. 11, a portion of the body 105 relative to the second terminal end 102 is urged so as to be bent along the semi cylinder slot 107, away from the first terminal end 101. Once appropriately bent or folded, as illustrated in FIG. 12, the second sidewall slot 119 is positioned proximate the first sidewall slot 119 (provided the distance between the semicylinder slot 117 and the second sidewall slot 119 is equal to a distance between the first terminal end 101 and the first terminal end 101).

Figure 14:
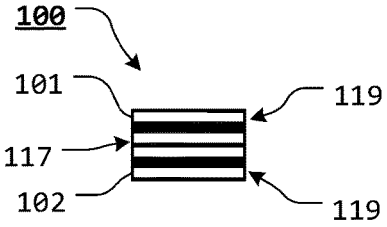
FIG. 14 illustrates a right side view of an exemplary embodiment of a carton divider in a packaging configuration, according to the present disclosure.
Figure 15:
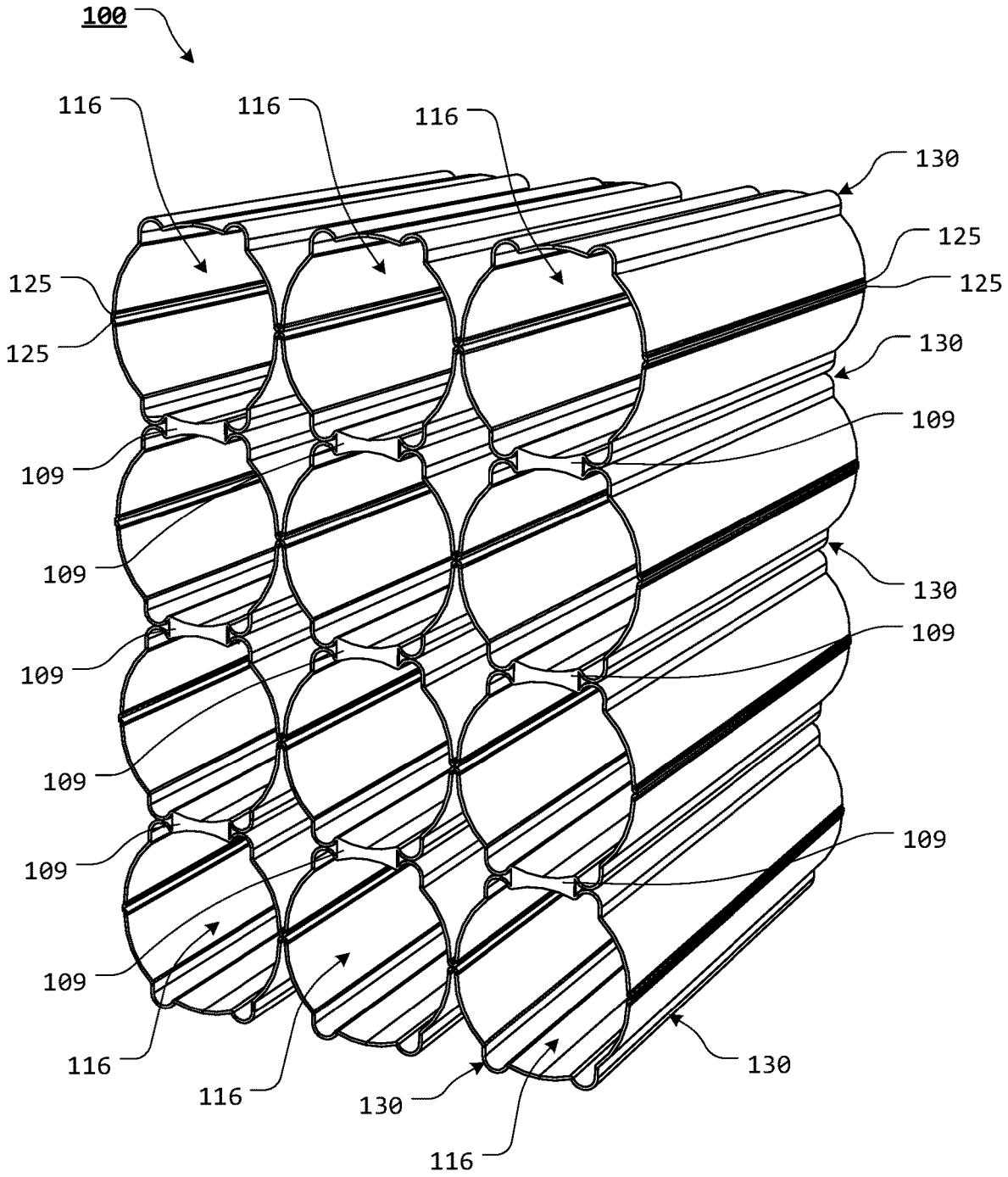
FIG. 15 illustrates an upper, front, right perspective view of an exemplary embodiment of a carton divider in a packaging configuration, according to the present disclosure.
Figure 16:
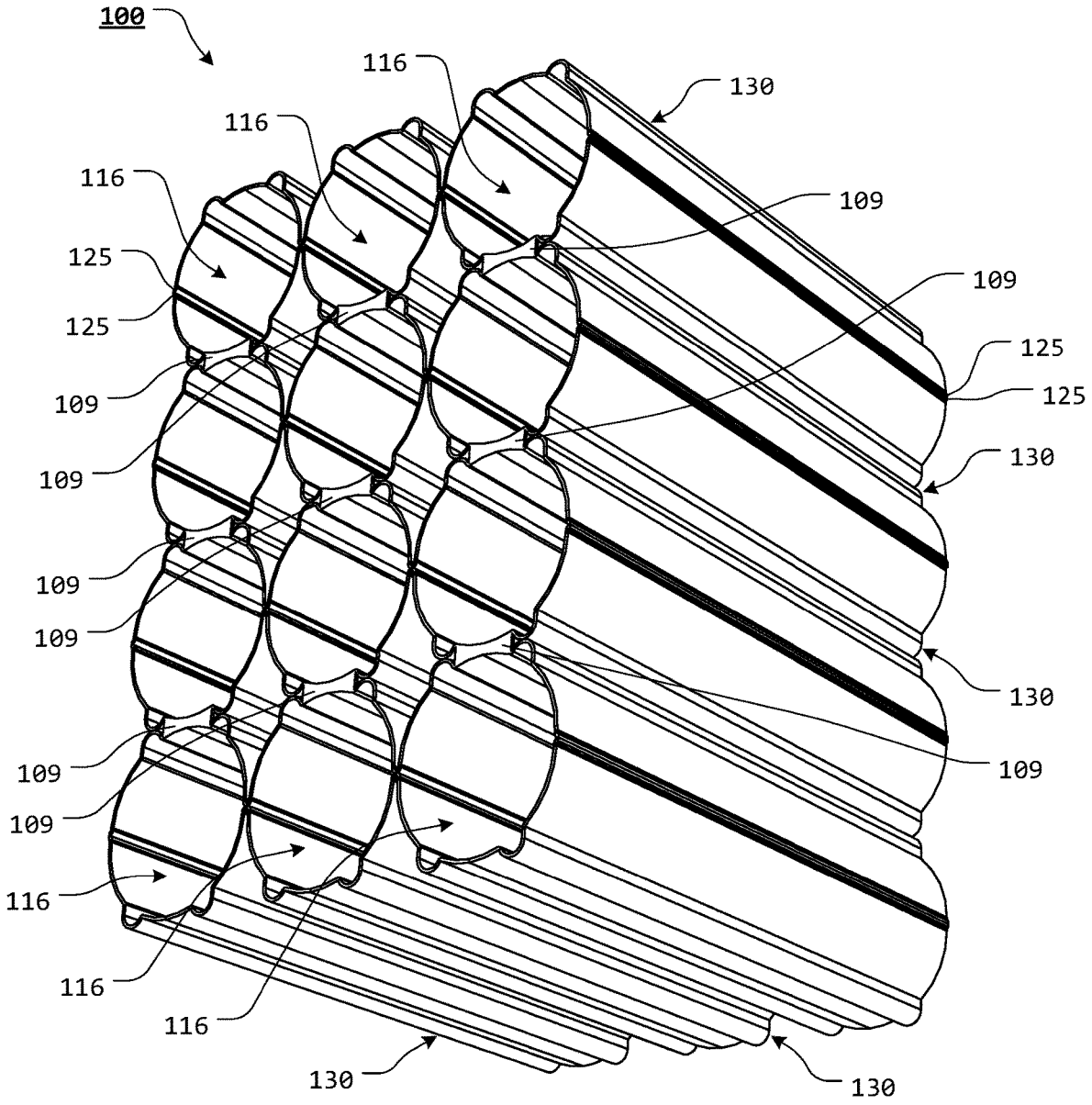
FIG. 16 illustrates a lower, front, right perspective view of an exemplary embodiment of a carton divider in a packaging configuration, according to the present disclosure.
Figure 17:
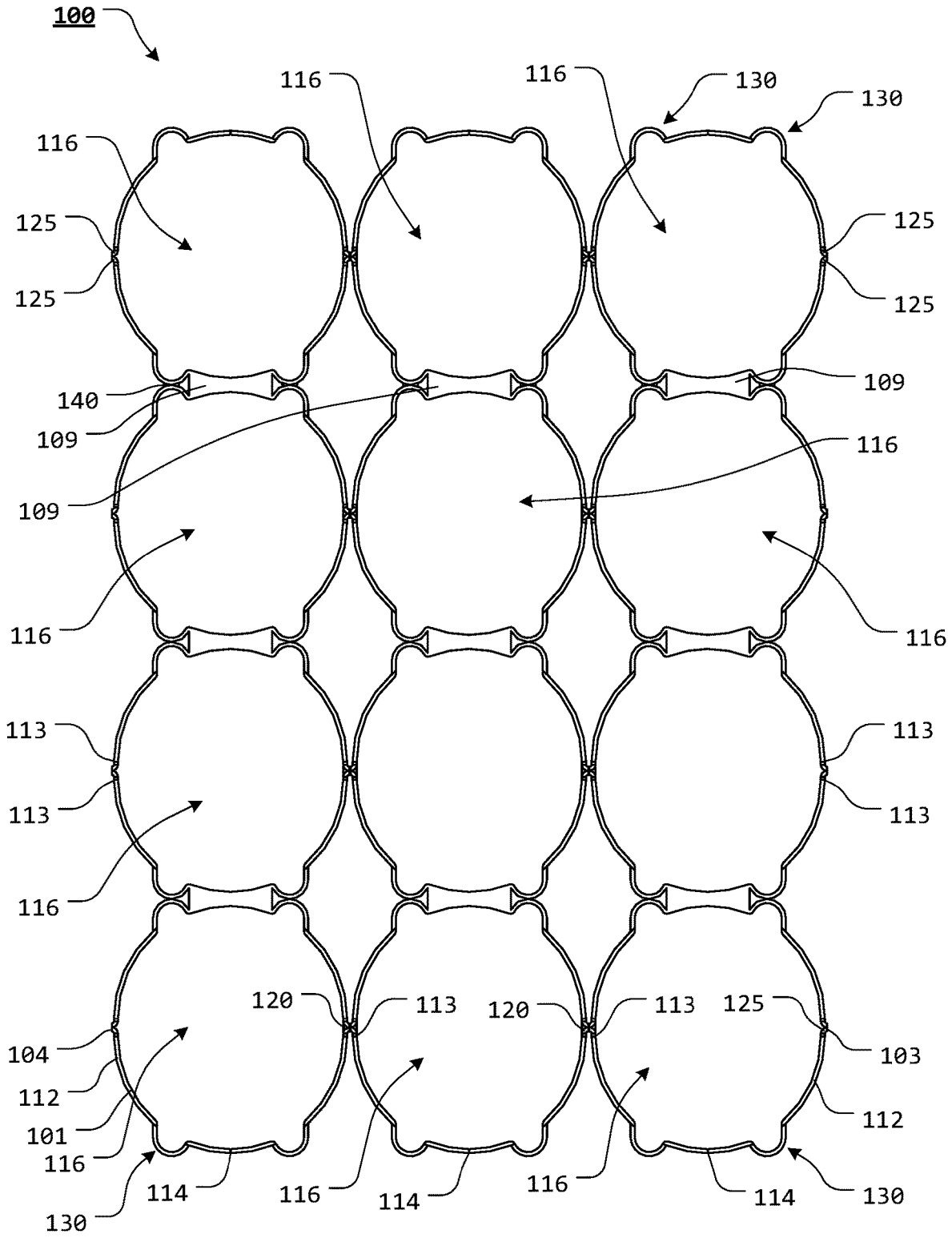
FIG. 17 illustrates a front view of an exemplary embodiment of a carton divider in a packaging configuration, according to the present disclosure.
Figure 18:
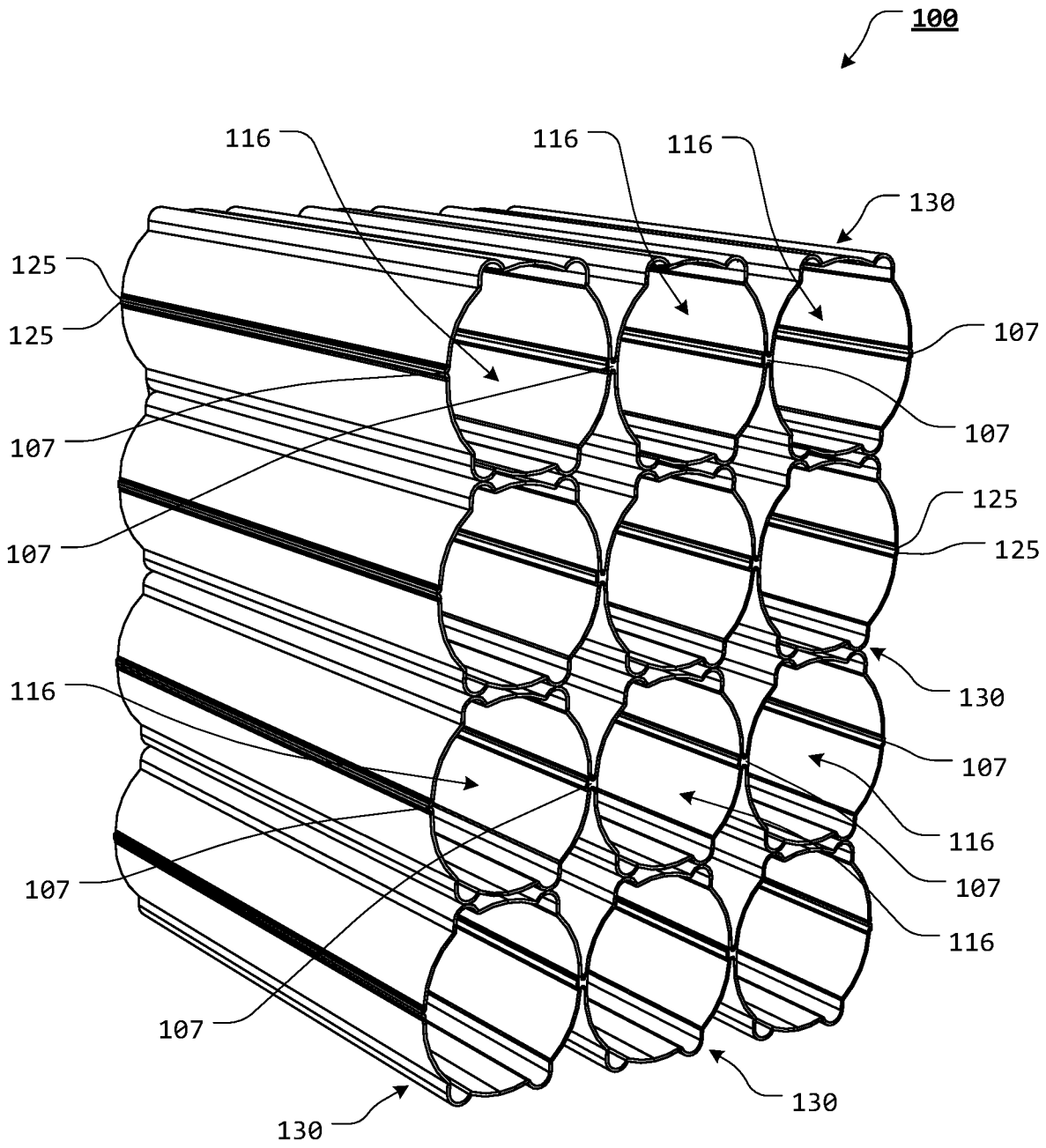
FIG. 18 illustrates an upper, rear, right perspective view of an exemplary embodiment of a carton divider in a packaging configuration, according to the present disclosure.
Figure 19:
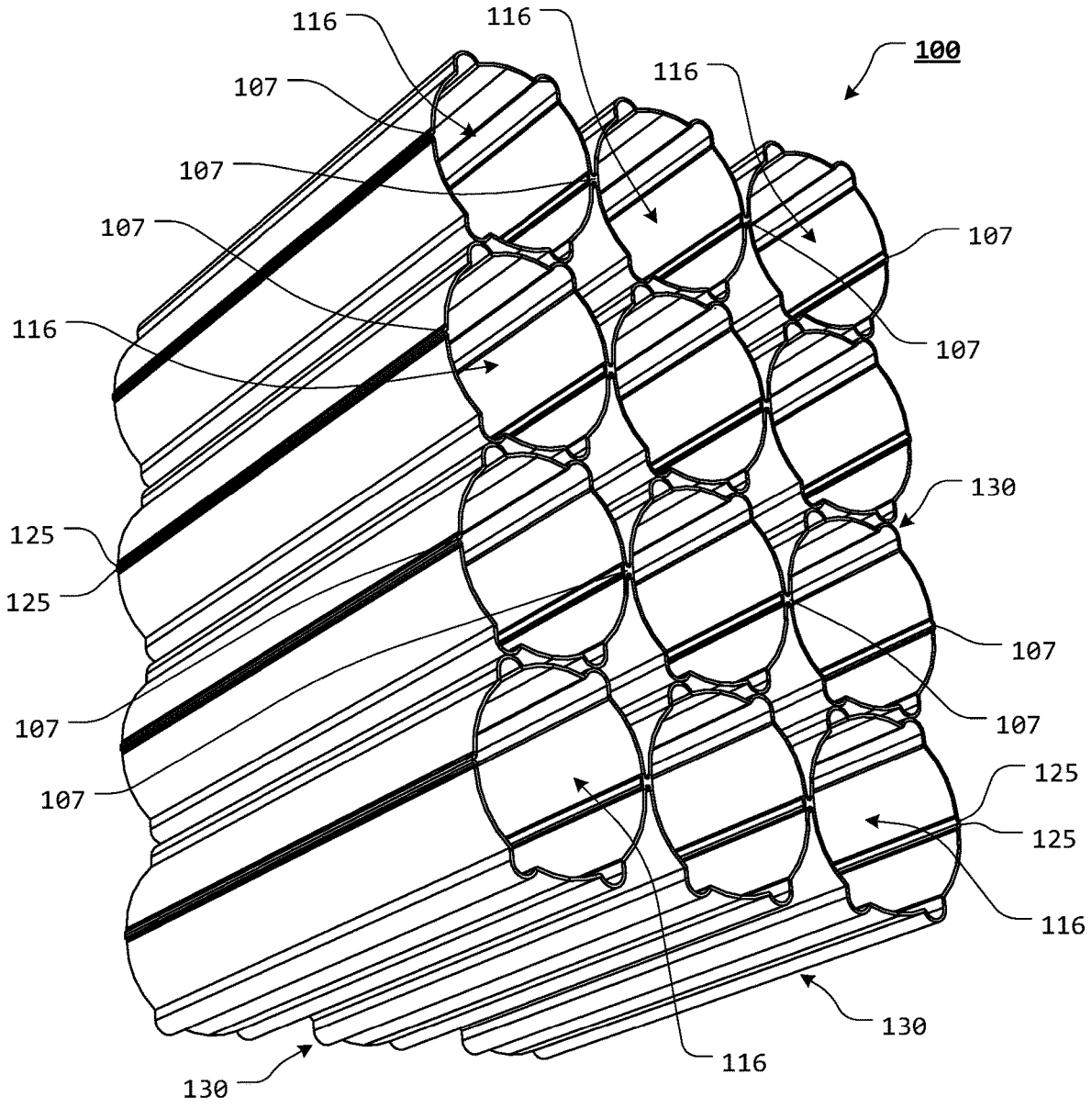
FIG. 19 illustrates a lower, rear, right perspective view of an exemplary embodiment of a carton divider in a packaging configuration, according to the present disclosure.
Figure 20:
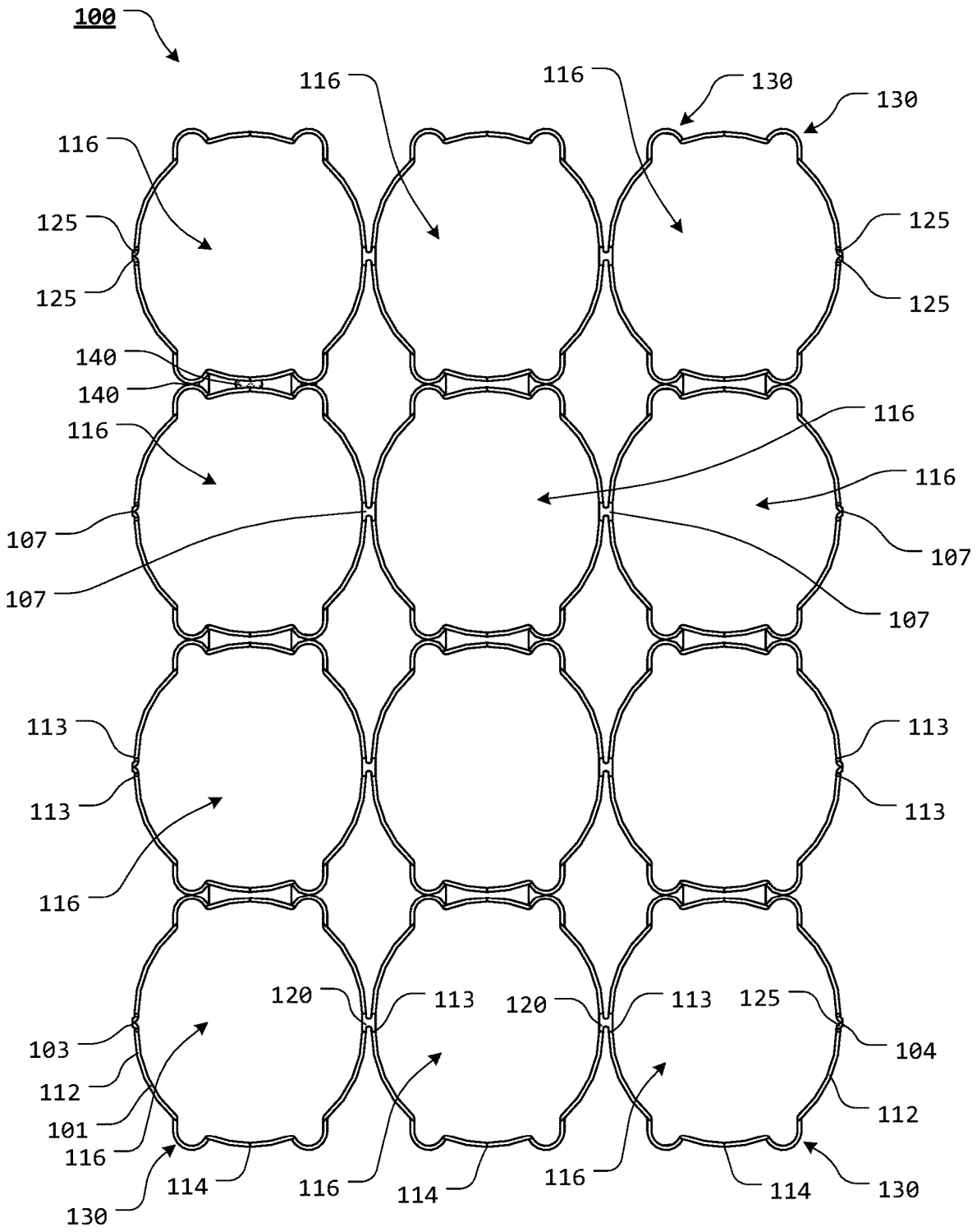
FIG. 20 illustrates a rear view of an exemplary embodiment of a carton divider in a packaging configuration, according to the present disclosure.

Then, as illustrated in FIG. 13, a portion of the body 105 relative to the second terminal end 102 is urged so as to be bent along the sidewall slot 119, toward the first terminal end 101. Once appropriately bent or folded, as illustrated in FIG. 14, the second terminal end 102 is positioned proximate the first sidewall slot 119 and the semicylinder slot 117 (provided the distance between the second sidewall slot 119 and the second terminal end 102 is equal to a distance between the semicylinder slot 117 and the second sidewall slot 119). In this configuration, the first sidewall slot 119 is positioned proximate the second sidewall slot 119.

When appropriately bent or folded into the packaging configuration, substantially cylindrical cavities 116 are formed between adjacent semicylindrical troughs 115.

in various exemplary, nonlimiting embodiments, adjacent, opposing portions of the vertex 114 and/or adjacent, opposing portions of stabilizing projections 130 may be attached or coupled to one another via an adhesive 140.

If attached or coupled by an adhesive 140, the adhesive 140 may comprise, for example, a hot melt, reactive hot melt, thermosetting, pressure sensitive, contact, binary, or other adhesive. In some embodiments, the wall portions may be pre-glued or may include an adhesive 140 that is initially covered by a removable strip so that the wall portions may be adhesively attached or coupled to one another by a user. Alternatively, the adhesive 140 may optionally be replaced or supplemented by a mechanical or other means, such as, for example, stapling. In still other exemplary embodiments, the body 105 may be maintained in a desired packaging configuration by forces applied to at least a portion of the body 105, when the carton divider 100 is positioned within the interior cavity 155 of the product carton or container 150.

FIGS. 15-22 illustrate various views of the carton divider 100 in the packaging configuration. As illustrated in FIGS. 15-22, the carton divider 100 is formed of a body 105 having three sidewall slots 119 (providing three sidewall hinge portions 109) and four semicylinder slots 117 (providing four sidewall hinge portions 109), each subsequent slot formed at an equally spaced distance.

Figure 21:
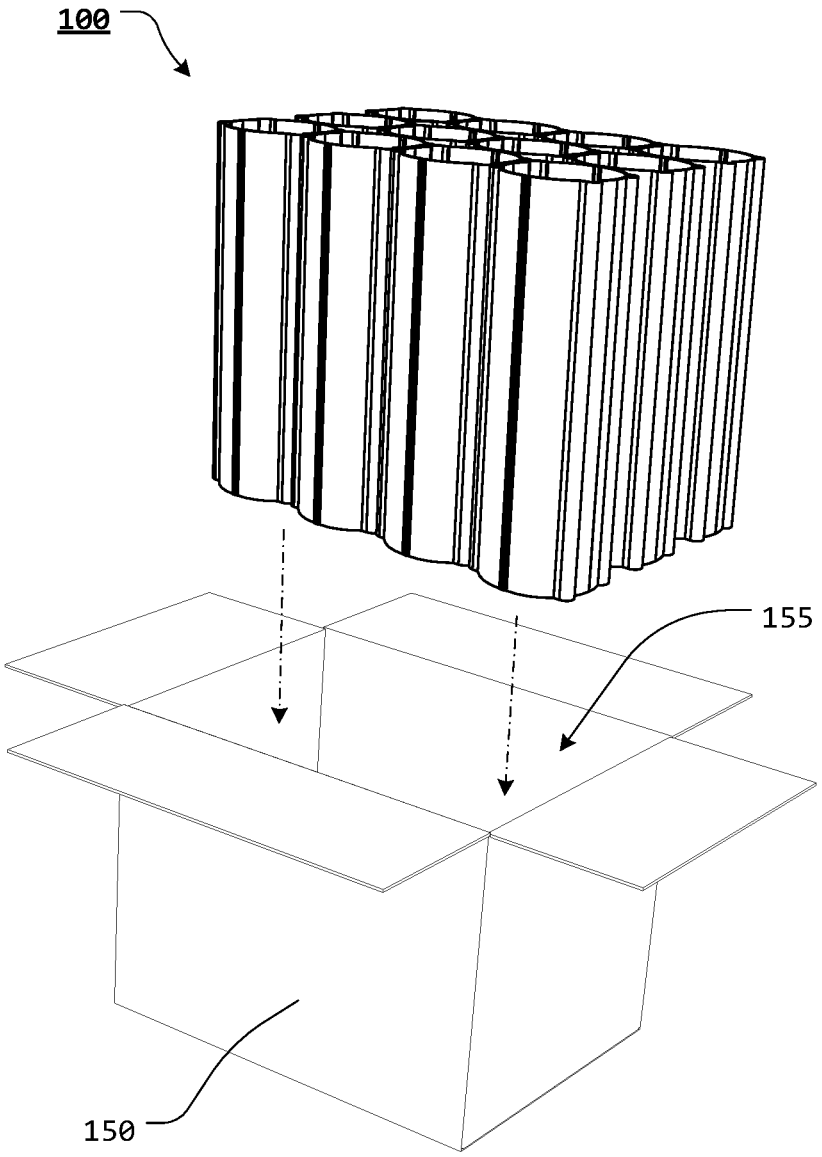
FIG. 21 illustrates a perspective view of an exemplary embodiment of a carton divider in a packaging configuration, wherein the carton divider is aligned with an interior cavity of an exemplary product carton or container, according to the present disclosure.
Figure 22:
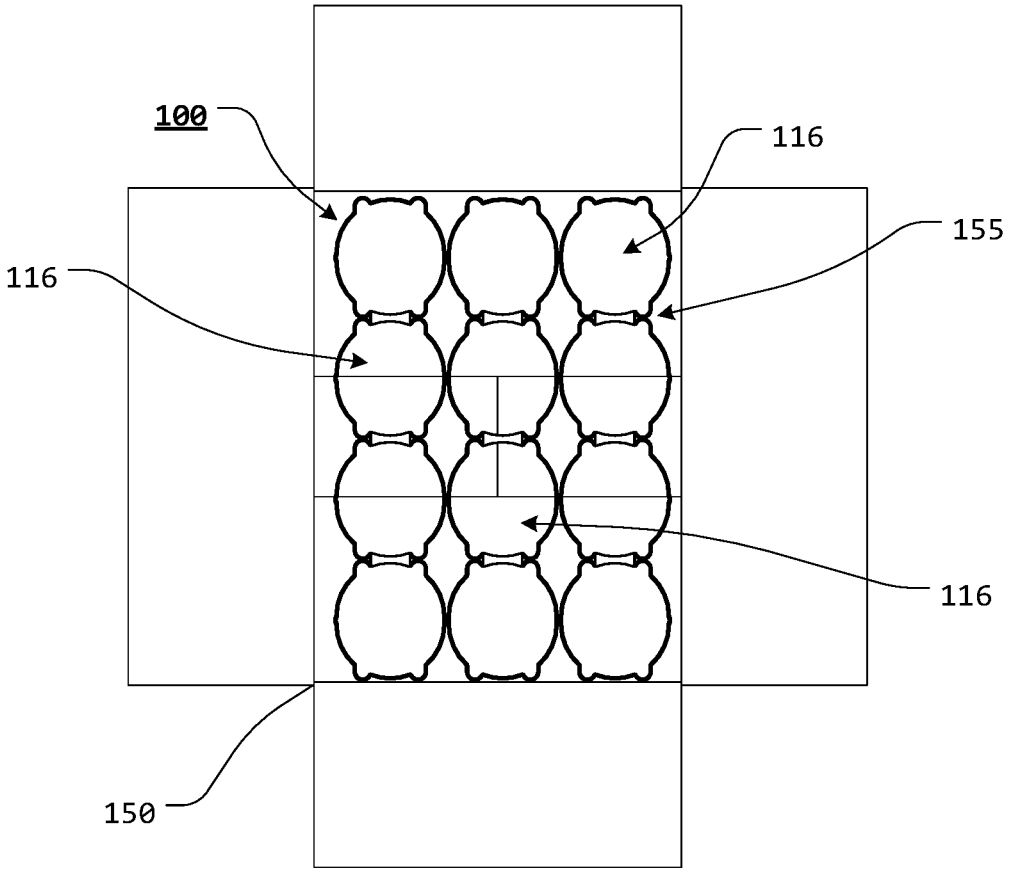
FIG. 22 illustrates a top view of an exemplary embodiment of a carton divider in a packaging configuration, wherein the carton divider is positioned within an interior cavity of an exemplary product carton or container, according to the present disclosure.

As illustrated in FIGS. 21-22, when the carton divider 100, as illustrated in FIGS. 15-22 is in a packaging configuration, it is positioned within the interior cavity 155 of a product carton or container 150. Once appropriately positioned, a product or item can be positioned within each substantially cylindrical cavity 116.

FIGS. 24-25 illustrate an exemplary embodiment of a body 105 of a carton divider 100, wherein the semicylinder slots 117 and the sidewall slots 119 are not formed in the body 105. In these exemplary embodiments, a first carton divider 100 can be positioned adjacent a second carton divider 100, which is oriented in a mirror image configuration relative to the first carton divider. By alternating carton dividers 100 in mirror image configurations, a portion of adjacent outer recurve portions 125 contact one another and a portion of adjacent intermediate recurve portions 120 contact one another. Similarly, a portion of adjacent stabilizing projections 130 contact. In these embodiments, an adhesive 140 or compressional forces may be utilized to maintain the individual carton dividers 100 and a desired position relative to one another and forming a carton divider 100, similar to those illustrated in FIGS.

FIGS. 26-30 illustrate an exemplary embodiment of the carton divider 100, wherein the stabilizing projections 130 are not included. Thus, it should be appreciated that the stabilizing projections 130, as illustrated and described with respect to FIGS. 1-25 are optional and the body 105 and carton divider 100 may be formed with or without the stabilizing projections 130.

The carton divider 100 may be constructed having an any desired overall size or shape. It should also be understood that the overall size and shape of the carton divider 100, and the various portions thereof, is a design choice based upon the desired functionality, compatibility with desired articles or products and/or appearance of the carton divider 100.

Thus, it should be appreciated that the number and shape of the intermediate recurve portions 125 and semicylindrical portions 110, and the overall length, width, and/or height of the carton divider 100 is a design choice, based upon the desired degree of packaging or cushioning provided by the carton divider 100 and/or the size and shape of the article or product with which the carton divider 100 is to be utilized.

During use, the carton divider 100 is positioned between articles or products or between an article or product and an inner surface of a package within which the article or product is to be at least partially positioned. Typically, the carton divider 100 is positioned within a void formed between the article or product and an inner surface of the product carton or container 150. Depending on the configuration of the package and article or product, one or more portions of an outer portion of the carton divider 100 contact portions of the surface of the interior cavity 155 of the product carton or container 150 and/or the article of or product to maintain the article or product in a desired position relative to the product carton or container 150 and provide package cushioning or support to the article or product during shipping, transport, or storage.

In certain exemplary embodiments, adhesives may be utilized to further secure the carton divider 100 in a desired position relative to either the article or product or to the interior cavity 155 of the product carton or container 150.

During shipping, transport, or storage of the article or product, the carton divider 100 helps to resist movement of the article or product within the product carton or container 150. Additionally, if the product carton or container 150 is bumped or jarred, causing the article or product to shift within the product carton or container 150, the body 105 allows for a degree of inward and/or outward flexion and resilient recovery toward the original shape of the carton divider 100. Furthermore, portions of the body 105 may partially or completely deform to absorb impact between the article or product in the product carton or container 150. Similarly, if an item impacts the exterior of the product carton or container 150, the stabilizing projections 130 may partially or completely deform to absorb impact between the product carton or container 150 and the article or product.

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Furthermore, where a range of values or dimensions is provided, it is understood that every intervening value or dimension, between the upper and lower limit of that range and any other stated or intervening value or dimension in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A carton divider, comprising:

an elongate portion of material, forming a body extending, along a longitudinal axis, from a first terminal end to a second terminal end and extending, along a transverse axis, from a terminating distal end to a terminating proximal end;

one or more adjacent semicylindrical portions, extending along a longitudinal axis, from said first terminal end to said second terminal end, wherein each semicylindrical portion includes a sidewall that extends between opposing terminating sidewall ends to a vertex formed between said opposing terminating sidewall ends;

an intermediate recurve portion extending along said entire length of said body, along said longitudinal axis, wherein said intermediate recurve portion joins said terminating sidewall ends of said adjacent semicylindrical portions;

a first outer recurve portion extending along said terminating sidewall end of an outermost one of said semicylindrical portions, wherein said first outer recurve portion extends between said terminating sidewall end of said outermost one of said semicylindrical portions and said terminating proximal end;

a second outer recurve portion extending along said terminating sidewall end of one other outermost one of said semicylindrical portions, wherein said second outer recurve portion extends between said terminating sidewall end of said other outermost one of said semicylindrical portions and said terminating distal end;

a plurality of stabilizing projections, wherein at least two stabilizing projections extend outwardly from each of said semicylindrical portions between one of said terminating sidewall ends and said vertex of each semicylindrical portion;

at least one semicylinder slot extending from said vertex toward said first outer recurve portion, said second outer recurve portion, and said intermediate recurve portions, wherein said at least one said semicylinder slot extends to but does not extend through said first outer recurve portion, said second outer recurve portion, and said intermediate recurve portions, and wherein portions of said first outer recurve portion, said second outer recurve portion, and said intermediate recurve portions proximate said semicylinder slot form recurve hinge portions; and at least one sidewall slot extending through and from a portion of said outer recurve portions and a portion of said intermediate recurve portions, toward said vertex, wherein said at least one sidewall slot extends through a portion of said sidewalls and through said stabilizing projections but does not extend through portions of said sidewalls proximate each said vertex and between said adjacent stabilizing projections of each of said adjacent semicylindrical portions, and wherein portions of each of said sidewalls proximate each said vertex and between said respective stabilizing projections forms a sidewall hinge portion.

2. The carton divider of claim 1, wherein said body extends continuously, along said longitudinal axis, from said first terminal end to said second terminal end.

3. The carton divider of claim 1, wherein said material used to form said body comprises a single layer of material.

4. The carton divider of claim 1, wherein said material used to form said body comprises multiple layers of similar or dissimilar materials joined or adhesively bonded together to form said body.

5. The carton divider of claim 1, wherein said body is formed of paperboard, chipboard, container board, box board, cardboard, or corrugated fiberboard.

6. The carton divider of claim 1, wherein a semicylindrical trough is defined within an interior of said sidewalls.

7. The carton divider of claim 1, wherein each of said stabilizing projections extends outward from each of said semicylindrical portions spaced apart from said vertex of each semicylindrical portion.

8. The carton divider of claim 1, wherein each of said stabilizing projections extends so as to be substantially coplanar, along said transverse axis, with said vertices of said semicylindrical portions.

9. The carton divider of claim 1, wherein each of said stabilizing projections is formed of a substantially circular or ovular projection extending from said semicylindrical portions.

10. The carton divider of claim 1, wherein said body is presented in an unfolded configuration.

11. The carton divider of claim 1, a plurality of carton dividers are presented in an unfolded configuration and are positioned adjacent one another such that at least a portion of said semicylindrical portions of a first carton divider is nested within at least a portion of said semicylindrical portions of a second, adjacent carton divider.

12. The carton divider of claim 1, wherein said at least one said semicylinder slot and said sidewall slots are formed at spaced apart locations in a repeating pattern between said first terminal end and said second terminal end.

13. The carton divider of claim 1, wherein said vertex of each respective semicylindrical portion is formed equidistance from said opposing terminating sidewall ends of said respective semicylindrical portion.

14. The carton divider of claim 1, wherein said at least one said semicylinder slot and said sidewall slots extend across said semicylindrical portions, parallel to said transverse axis of said carton divider and is formed of an elongate slip, groove, cut, or separation through said body.

15. The carton divider of claim 1, wherein said at least one said semicylinder slot and said sidewall slots are formed of perforations through said body.

16. The carton divider of claim 1, wherein said at least one said semicylinder slot and said sidewall slots provide flexible or semi-flexible areas or portions of material such that portions of said body may be folded along said at least one said semicylinder slot and said sidewall slots.

17. The carton divider of claim 1, wherein one semicylinder slot is formed proximate a center of said body and wherein two sidewall slots are formed at spaced apart locations along said body.

18. The carton divider of claim 1, wherein said at least one said semicylinder slot and said sidewall slots are formed substantially equidistant from one another.

19. A carton divider, comprising:

an elongate body extending, along a longitudinal axis, from a first terminal end to a second terminal end and extending, along a transverse axis, from a terminating distal end to a terminating proximal end;

one or more adjacent semicylindrical portions, extending substantially parallel to said longitudinal axis, from said first terminal end to said second terminal end, wherein each semicylindrical portion includes a sidewall that extends between opposing terminating sidewall ends, wherein a vertex is formed between said opposing terminating sidewall ends;

an intermediate recurve portion extending substantially parallel to said longitudinal axis, wherein said intermediate recurve portion joins said terminating sidewall ends of said adjacent semicylindrical portions;

a first outer recurve portion extending along said terminating sidewall end of an outermost one of said semicylindrical portions, wherein said first outer recurve portion extends between said terminating sidewall end of said outermost one of said semicylindrical portions and said terminating proximal end;

a second outer recurve portion extending along said terminating sidewall end of one other outermost one of said semicylindrical portions, wherein said second outer recurve portion extends between said terminating sidewall end of said other outermost one of said semicylindrical portions and said terminating distal end;

a plurality of stabilizing projections, wherein at least two stabilizing projections extend outwardly from each of said semicylindrical portions between said terminating sidewall ends and said vertex of each semicylindrical portion;

at least one semicylinder slot extending from said vertex toward said first outer recurve portion, said second outer recurve portion, and said intermediate recurve portions, wherein said at least one said semicylinder slot extends to said first outer recurve portion, said second outer recurve portion, and said intermediate recurve portions, and wherein portions of said first outer recurve portion, said second outer recurve portion, and said intermediate recurve portions proximate said semicylinder slot form recurve hinge portions; and at least one sidewall slot extending through a portion of said outer recurve portions and a portion of said intermediate recurve portions, toward said vertex, wherein said at least one sidewall slot extends through a portion of said sidewalls and through said stabilizing projections but does not extend through portions of said sidewalls proximate each said vertex and between said adjacent stabilizing projections of each of said adjacent semicylindrical portions, and wherein portions of each of said sidewalls proximate each said vertex and between said respective stabilizing projections forms a sidewall hinge portion.

20. A carton divider, comprising:

an elongate body extending, along a longitudinal axis, from a first terminal end to a second terminal end and extending, along a transverse axis, from a terminating distal end to a terminating proximal end;

one or more adjacent semicylindrical portions, extending substantially parallel to said longitudinal axis, from said first terminal end to said second terminal end, wherein each semicylindrical portion includes a sidewall that extends between opposing terminating sidewall ends, wherein a vertex is formed between said opposing terminating sidewall ends;

an intermediate recurve portion, wherein said intermediate recurve portion joins said terminating sidewall ends of said adjacent semicylindrical portions;

a first outer recurve portion extending along said terminating sidewall end of an outermost one of said semicylindrical portions, wherein said first outer recurve portion extends between said terminating sidewall end of said outermost one of said semicylindrical portions and said terminating proximal end;

a second outer recurve portion extending along said terminating sidewall end of one other outermost one of said semicylindrical portions, wherein said second outer recurve portion extends between said terminating sidewall end of said other outermost one of said semicylindrical portions and said terminating distal end;

at least one semicylinder slot extending from said vertex toward said first outer recurve portion, said second outer recurve portion, and said intermediate recurve portions, wherein said at least one said semicylinder slot extends to said first outer recurve portion, said second outer recurve portion, and said intermediate recurve portions, and wherein portions of said first outer recurve portion, said second outer recurve portion, and said intermediate recurve portions proximate said semicylinder slot form recurve hinge portions; and at least one sidewall slot extending through a portion of said outer recurve portions and a portion of said intermediate recurve portions, toward said vertex, wherein said at least one sidewall slot extends through a portion of said sidewalls but does not extend through portions of said sidewalls proximate each said vertex, and wherein portions of each of said sidewalls proximate each said vertex forms a sidewall hinge portion.

* * * * *